US005711970A

United States Patent [19]

Lau et al.

[11] Patent Number: 5,711,970

[45] Date of Patent: Jan. 27, 1998

[54] APPARATUS FOR THE PRODUCTION OF FIBERS AND MATERIALS HAVING ENHANCED CHARACTERISTICS

[75] Inventors: Jark Chong Lau, Roswell; Bryan David Haynes, Alpharetta, both of Ga.

[73] Assignee: Kimberly-Clark Worldwide, Inc., Neenah, Wis.

[21] Appl. No.: 510,354

[22] Filed: Aug. 2, 1995

[51] Int. Cl.[6] ..... D01D 5/00

[52] U.S. Cl. ..... 425/72.2; 425/131.1; 425/140; 425/464; 264/211; 264/12; 264/211.14

[58] Field of Search ..... 425/72.2, 140, 425/464, 7, 72.1, 131.1; 264/12, 176.1, 211.12, 211.14

[56] References Cited

U.S. PATENT DOCUMENTS

| | | | |
|---|---|---|---|
| 1,856,401 | 5/1932 | Prince | 425/72.2 |
| 2,065,124 | 12/1936 | Drefus et al. | 425/72.2 |
| 2,574,221 | 11/1951 | Modigliani | 154/80 |
| 2,954,271 | 9/1960 | Cenzato . | |
| 2,982,310 | 5/1961 | West | 137/793 |

(List continued on next page.)

FOREIGN PATENT DOCUMENTS

| | | |
|---|---|---|
| 1308528 | 6/1962 | France . |
| 1373768 | 9/1962 | France . |
| 2217459 | 9/1974 | France . |
| 2302928 | 7/1974 | Germany . |
| 4014989 | 1/1991 | Germany . |
| 4014-413-A | 11/1991 | Germany . |
| 47-00090 | 11/1969 | Japan . |
| 46-34373 | 10/1971 | Japan . |
| 47-9527 | 3/1972 | Japan . |
| 47-32136 | 8/1972 | Japan . |
| 48-380025 | 11/1973 | Japan . |
| 52-5631 | 2/1977 | Japan . |
| WO 86/04936 | 8/1986 | Japan . |
| 5-195309 | 8/1993 | Japan . |
| 533304 | 2/1941 | United Kingdom . |
| 749779 | 5/1956 | United Kingdom . |
| 1157695 | 7/1969 | United Kingdom . |
| 1219921 | 1/1971 | United Kingdom . |

OTHER PUBLICATIONS

"Melt Blowing: General Equation Development and Experimental Verification," Marc A.J. Uyttendaele and Robert L. Shambaugh, *AICHE Journal*, Feb. 1990, vol. 36, No. 2, pp. 175–186.

"The Manufacture of Continuous Polymeric Filaments by the Melt–Blowing Process," John C. Kayser and Robert L. Shambaugh, *Polymer Engineering and Science*, Mid–Oct. 1990, vol. 30, No. 19, pp. 1237–1251.

"A Macroscopic View of the Melt–Blowing Process for Producing Microfibers," Robert L. Shambaugh, *J&EC Research*, 1988, 27, 23763, pp. 2363–2372.

"Experimental Investigation of Oscillatory Jet–Flow Effects," M.F. Platzer, L.J. Deal, Jr. and W.S. Johnson, Naval Postgraduate School, Monterey, California, pp. 392–414.

*Primary Examiner*—Khanh P. Nguyen
*Attorney, Agent, or Firm*—William D. Herrick

[57] ABSTRACT

An apparatus for forming artificial fibers and a non-woven web therefrom includes a device for generating a substantially continuous fluid stream along a primary axis, at least one extrusion die located adjacent to the continuous fluid stream for extruding a liquefied resin into fibers, a member for entraining the fibers in the primary fluid stream, and a perturbation mechanism for selectively perturbing the flow of fluid in the fluid stream by varying the fluid pressure on either side of the primary axis to produce crimped fibers for forming the non-woven web. The inventive manufacturing method finely tunes non-woven web material characteristics such as tensile strength, porosity, barrier properties, absorbance, and softness by varying the fluid stream perturbation frequency and amplitude. Finally, the inventive apparatus may be implemented in combination with melt-blown, spunbond and coform techniques for producing non-woven webs.

40 Claims, 20 Drawing Sheets

U.S. PATENT DOCUMENTS

| | | | |
|---|---|---|---|
| 3,061,401 | 10/1962 | Studer et al. . | |
| 3,110,059 | 11/1963 | Tallis et al. . | |
| 3,207,587 | 9/1965 | Fulk | 65/5 |
| 3,282,668 | 11/1966 | Mabru | 65/12 |
| 3,436,792 | 4/1969 | Hench . | |
| 3,438,104 | 4/1969 | Stoller | 28/72 |
| 3,442,633 | 5/1969 | Perry | 65/3 |
| 3,444,587 | 5/1969 | Polovets et al. . | |
| 3,509,009 | 4/1970 | Hartmann | 161/150 |
| 3,568,716 | 3/1971 | Heitzman | 137/624.14 |
| 3,616,037 | 10/1971 | Burger | 156/303 |
| 3,663,206 | 5/1972 | Lubanska | 75/60 |
| 3,682,734 | 8/1972 | Burger | 156/166 |
| 3,802,037 | 4/1974 | Sakai | 28/72.1 |
| 3,802,817 | 4/1974 | Matsuki et al. | 425/66 |
| 3,825,379 | 7/1974 | Lohkamp et al. | 425/72 |
| 3,825,380 | 7/1974 | Harding et al. | 425/72 |
| 3,920,362 | 11/1975 | Bradt | 425/72 |
| 3,954,361 | 5/1976 | Page | 425/72.2 |
| 3,967,118 | 6/1976 | Sternberg | 250/325 |
| 3,970,417 | 7/1976 | Page | 425/72.2 |
| 3,999,909 | 12/1976 | Schippers | 425/72 S |
| 4,003,774 | 1/1977 | Lebet et al. | 156/180 |
| 4,015,963 | 4/1977 | Levecque et al. | 65/5 |
| 4,058,960 | 11/1977 | Movschovich et al. | 57/34 AT |
| 4,070,218 | 1/1978 | Weber | 156/167 |
| 4,102,662 | 7/1978 | Levecque et al. | 65/5 |
| 4,113,456 | 9/1978 | Levecque et al. | 65/5 |
| 4,118,213 | 10/1978 | Levecque et al. | 65/5 |
| 4,123,243 | 10/1978 | Levecque et al. | 65/16 |
| 4,137,059 | 1/1979 | Levecque et al. | 65/5 |
| 4,146,378 | 3/1979 | Levecque et al. | 65/5 |
| 4,159,199 | 6/1979 | Levecque et al. | 65/5 |
| 4,185,981 | 1/1980 | Ohsato et al. | 65/5 |
| 4,211,737 | 7/1980 | Di Drusco et al. | 264/12 |
| 4,285,452 | 8/1981 | Reba et al. | 226/7 |
| 4,316,731 | 2/1982 | Lin et al. | 65/5 |
| 4,374,888 | 2/1983 | Bornslaeger | 428/198 |
| 4,380,570 | 4/1983 | Schwarz | 428/296 |
| 4,444,961 | 4/1984 | Timm | 526/88 |
| 4,472,329 | 9/1984 | Muschellknautz et al. | 264/12 |
| 4,478,248 | 10/1984 | DeVall et al. | 137/624.13 |
| 4,526,733 | 7/1985 | Lau | 264/12 |
| 4,622,259 | 11/1986 | McAmish et al. | 428/171 |
| 4,623,706 | 11/1986 | Timm et al. | 526/88 |
| 4,643,215 | 2/1987 | Phlipot | 137/15 |
| 4,666,673 | 5/1987 | Timm | 422/135 |
| 4,692,106 | 9/1987 | Grabowski et al. | 425/66 |
| 4,787,417 | 11/1988 | Windsor, Jr. | 137/624.13 |
| 4,818,463 | 4/1989 | Buehning | 264/40.1 |
| 4,818,464 | 4/1989 | Lau | 264/510 |
| 4,818,466 | 4/1989 | Mente et al. | 264/555 |
| 4,820,142 | 4/1989 | Balk | 425/66 |
| 4,847,035 | 7/1989 | Mente et al. | 264/555 |
| 4,992,124 | 2/1991 | Kurihara et al. | 156/161 |
| 5,075,068 | 12/1991 | Milligan et al. | 264/555 |
| 5,080,569 | 1/1992 | Gubernick et al. | 425/7 |
| 5,087,186 | 2/1992 | Buehning | 425/72.2 |
| 5,098,636 | 3/1992 | Balk | 264/555 |
| 5,143,121 | 9/1992 | Steinhardt et al. | 137/624.13 |
| 5,148,946 | 9/1992 | Mizuta et al. | 222/1 |
| 5,160,746 | 11/1992 | Dodge, II et al. | 425/7 |
| 5,164,198 | 11/1992 | Bauckhage et al. | 425/6 |
| 5,196,207 | 3/1993 | Koenig | 425/72.2 |
| 5,242,150 | 9/1993 | Shiffler et al. | 251/209 |
| 5,244,607 | 9/1993 | Rheutan, Jr. et al. | 264/23 |
| 5,244,723 | 9/1993 | Anderson et al. | 428/283 |
| 5,248,455 | 9/1993 | Joseph et al. | 264/6 |
| 5,262,110 | 11/1993 | Spaller, Jr. et al. | 264/207 |
| 5,312,500 | 5/1994 | Kurihara et al. | 156/62.4 |
| 5,353,838 | 10/1994 | Grant | 137/624.13 |
| 5,364,680 | 11/1994 | Cotton | 428/126 |
| 5,405,559 | 4/1995 | Shaumbaugh | 364/6 |
| 5,435,708 | 7/1995 | Kaun | 425/72.2 |

EFFECT OF PERTURBATION FREQUENCY ON FRAZIER POROSITY.

EFFECT OF PERTURBATION FREQUENCY ON HYDROHEAD.

VARIATION IN PEAK LOAD WITH FREQUENCY IN A SPUNDBOUND APPARATUS.

APPARATUS FOR THE PRODUCTION OF FIBERS AND MATERIALS HAVING ENHANCED CHARACTERISTICS

FIELD OF THE INVENTION

This invention relates generally to the production of man-made fibers, and particularly, to the field of production of man-made fibers using melt-blown, coform and spunbond techniques.

BACKGROUND OF THE INVENTION

The production of man-made fibers has long used melt-blown, coform and spunbond techniques to produce fibers for use in forming non-woven webs of material. FIGS. 1*a* through 3*b* illustrate prior art machines which manufacture non-woven webs from melt-blown and spunbond techniques. Additionally, prior art coform techniques are discussed in greater detail hereinafter.

FIGS. 1*a*–1*c* illustrate a typical approach for producing melt-blown fibers. Referring to FIG. 1*a*, a hopper 10 contains pellets of resin. Extruder 12 melts the resin pellets by a conventional heating arrangement to form a molten extrudable composition which is extruded through a melt-blowing die 14 by the action of a turning extruder screw (not shown) located within the extruder 12. As shown in FIG. 1*c*, the extrudable composition is fed to the orifice 18 through extrusion slot 28. The die 14 and the gas supply fed therethrough are heated by a conventional arrangement (not shown).

FIG. 1*b* illustrates the die 14 in greater detail. The tip 16 of die 14 contains a plurality of melt-blowing die orifices 18 which are arranged in a linear array across the face 16. Referring now to FIG. 1*c*, inlets 20 and 21 feed heated gas to the plenum chambers 22 and 23. The gas then exits respectively through the passages 24 and 25 to converge and form a gas stream which captures and attenuates the polymer or resin threads extruded from orifices 18 to form a gas borne stream of fibers 26 as is seen in FIG. 1*a*.

The melt-blowing die 14 includes a die member 36 having a base portion 38 and a protruding central portion 39 within which an extrusion slot 28 extends in fluid communication with the plurality of orifices 18, the outer ends of which terminate at the die tip. The gas borne stream of fibers 26 is projected onto a collecting device which in the embodiment illustrated in FIG. 1*a* includes a foraminous endless belt 30 carried on rollers 31 and which may be fitted with one or more stationary vacuum chambers (not shown) located beneath the collecting surface on which a non-woven web 34 of fibers is formed. The collected entangled fibers form a coherent web 34, a segment of which is shown in plan view in FIG. 2. The web 34 may be removed from the belt 30 by a pair of pinch rollers 33 (shown in FIG. 1*a*) which press the entangled fibers together. The prior art melt-blowing apparatus of FIGS. 1*a*–1*c* may optionally include pattern-embossing means as by patterned calender nip or ultrasonic embossing equipment (not shown) and web 34 may thereafter be taken up on a storage roll or passed to subsequent manufacturing steps. Other embossing means may be utilized such as the pressure nip between a calender and an anvil roll, or the embossing step may be omitted altogether.

FIG. 3*a* illustrates a prior art apparatus 44 for producing spunbond fibers. The spunbond apparatus typically contains a fiber draw unit 46 positioned above an endless belt 78 which is supported on rollers 76. FIG. 3*b* illustrates the fiber draw unit in greater detail. Fiber draw unit 46 includes upper air regions 48 and 50 and a longitudinal air chamber which contains an upper portion 52, a mid-portion 54, and a lower portion or tail pipe 56. The fiber draw unit also includes a first air plenum 58 and an air inlet 60 leading from the first air plenum 58 to mid-portion 54 of the fiber draw unit. Additionally, a second air plenum 62 also communicates with mid-portion 54 of the fiber draw unit via air inlet 64. The spunbond apparatus 44 also includes standard equipment for melting an extruding resin through dies to create fibers 68. Typically, this equipment feeds resin fed from a supply to a hopper extruder, through a filter, and finally through a die to create the fibers 68.

High velocity air is admitted into the fiber draw unit through plenums 58 and 62 via inlets 72 and 74, respectively. The addition of air to the fiber draw unit through inlets 60 and 64 aspirates air through inlets 50 and 48. The air and fibers then exit through tail pipe 56 into exit area 70. Generally, air admitted into the fiber draw unit through inlets 50 and 48 draws fibers 68 as they pass through the fiber draw unit. The drawn fibers are then laid down on endless belt 78 to form a non-woven web 80 as is seen in FIG. 3*a*. Rollers 82 may then remove the non-woven web from the endless belt 78 and further press the entangled fibers together to assist in forming the web. The web 80 is then bonded, such as by embossing by calender and anvil, ultrasonic embossing, or other known technique, to form the finished material.

It is well known in the art to vary a number of processing parameters in both melt-blown and spunbond fiber forming processes to obtain fibers of desired properties in order to form fabrics with desired characteristics. However, the majority of prior art techniques for varying fiber characteristics required more time consuming changes in machinery or process, such as changing dies or changing the resins. Therefore, those techniques required that the production line be halted while the necessary changes were made, which resulted in inefficiency when a new material was to be run.

The prior art has previously taught that various effects can be obtained by the manipulation of air flow near the fiber exit in melt-blown and spunbond fiber producing equipment. For example, Shambaugh, U.S. Pat. No. 5,405,559, teaches that the air flow provided in the melt-blown process can be alternately turned on and off on both sides of the die, thus reducing the energy required to produce melt-blown fiber. However, this teaching of Shambaugh has several drawbacks. Under some conditions, the complete shutting off of the air on either side will tend to blow the liquefied resin onto the air plates on the other side of the die, thereby clogging the machinery for typical production airflow rates (especially with high MFR polymers or other polymers normally used in non-woven web production). Further, such techniques would likely result in the deposition of resin globs or "shot", on the production web since the resin would be affected only minimally during the transition from airflow on one side of the die to the other. Finally, while the Shambaugh reference teaches switching air on and off for the purposes of reducing fiber size for a given flow, its main emphasis is that such switching saves energy by reducing the overall airflow requirements in the melt-blown process.

Moreover, the low frequencies taught by Shambaugh would result in poor formation on a high speed machine. Fibers produced as given in the examples are coarser, e.g. larger diameters than typically found in non-woven commercial production. Finally, Shambaugh teaches no applicability of selective alteration of airflow characteristics for varying fiber parameters in a spunbond fiber production environment.

U.S. Pat. No. 5,075,068, teaches the use of a steady state shearing air stream near the exit of the die in the melt-blown process for the purpose of increased drag on fibers exiting the die. The steady state air stream therefore draws the fibers further and enhances the quenching of the fibers. However, this patent teaches a steady state airflow for producing a better fiber, but does not teach that airflow characteristics may be selectively altered to vary the characteristics of fibers in a desired manner.

Finally, U.S. Pat. No. 5,312,500, teaches alternating airflows at the exit of a spunbond fiber draw unit for laying a continuous fiber down in an elliptical fashion to form a non-woven web. This patent teaches that, among other techniques, varying airflows may direct fibers onto a foraminous forming surface to form a non-woven web. By varying the manner in which the fibers are deposited using airflow variation, this reference states that the characteristics of the web may be enhanced. However, this reference does not teach that the airflows may be used to enhance or vary the characteristics of the fibers themselves.

Therefore, it is an object of the present invention to provide novel methods for the production of fibers.

It is a further object of the present invention to provide techniques whereby desired characteristics of fibers may be selected through process control.

It is an additional object of the present invention to provide non-woven webs having desired characteristics through the production of fibers using perturbed airflows during fiber formation.

It is yet another object of the present invention to provide a process and apparatus for the formation of fibers having specific, desired characteristics by the simple, selective variation of the frequency and/or amplitude of perturbation of air flow during the production of the fibers.

It is yet a further object of the present invention to provide processes and apparati, using selective variation of the frequency and/or amplitude of a perturbing airflow in the formation of fibers, which allow for the production of non-woven webs and fabrics having desired characteristics.

SUMMARY OF THE INVENTION

The above and further objects are realized in a process and apparatus for the production of fibers in accordance with disclosed and preferred embodiments of the present invention and resulting non-woven webs.

Generally, the present invention relates to an apparatus for forming artificial fibers from a liquefied resin and for forming a non-woven web. The apparatus may include means for generating a substantially continuous airstream for entraining fibers along a primary axis, at least a first extrusion die located next to the airstream for extruding the liquefied resin, and perturbation means for selectively perturbing the air stream by varying the air pressure on either side or both sides of the primary axis. The apparatus may also include a substrate disposed below the first die and substrate translation means for moving the substrate relative to the die, wherein the entrained fibers are deposited on the substrate to form a non-woven web.

The apparatus may include a first supply of air connected to first and second air plenum chambers located on opposite sides of the axis, wherein plenum chambers outlets provide a substantially continuous air stream for fiber attenuation. The perturbation means may include a valve for selectively varying the airflow rate to the first and second plenums, thereby providing airflow perturbation to the entrained fibers. Additionally, airstream perturbation may be achieved by superimposing a perturbed secondary air supply on the first air supply within the plenum chambers. Alternatively, the perturbation means may include first and second pressure transducers adjacent or attached to the first and second plenum chambers and means for selective activation of the first and second pressure transducers for selectively varying the pressure in the first and second plenum chambers. Generally, the perturbation means varies a steady state pressure in the first and second plenum chambers at a perturbation frequency of approximately less than 1000 Hertz and varies an average plenum pressure in the first and second plenum chamber up to about 100% of the total average plenum pressure in the absence of activation of the perturbation means.

The apparatus may also include a fiber draw unit disposed below the first die and adapted to channel the primary air flow therethrough. The fiber draw unit may include a fiber inlet at a top portion thereof for receiving fluid flow and fibers entrained therein and an outlet for dispensing the air entrained fibers onto the substrate. The apparatus may also include a multiple die arrangement for extruding several types of resin simultaneously, as well as means for adding other fibers or particulates (coform).

The apparatus may also include first and second secondary perturbing air supplies disposed on opposite sides of said axis and near the die or fiber draw unit for alternatingly perturbing the substantially continuous flow of air.

The present invention also relates to a method for forming artificial fibers from a liquefied resin and forming a non-woven web thereby, comprising the steps of generating a substantially continuous air stream along a primary axis, extruding the liquefied resin through a first die located adjacent to the air stream, entraining the liquefied resin in the air stream to form fibers, and selectively perturbing the flow of air in the airstream by varying the air pressure on either side of the primary axis.

DETAILED DESCRIPTION OF THE PREFERRED EMBODIMENTS

Figure 1A:
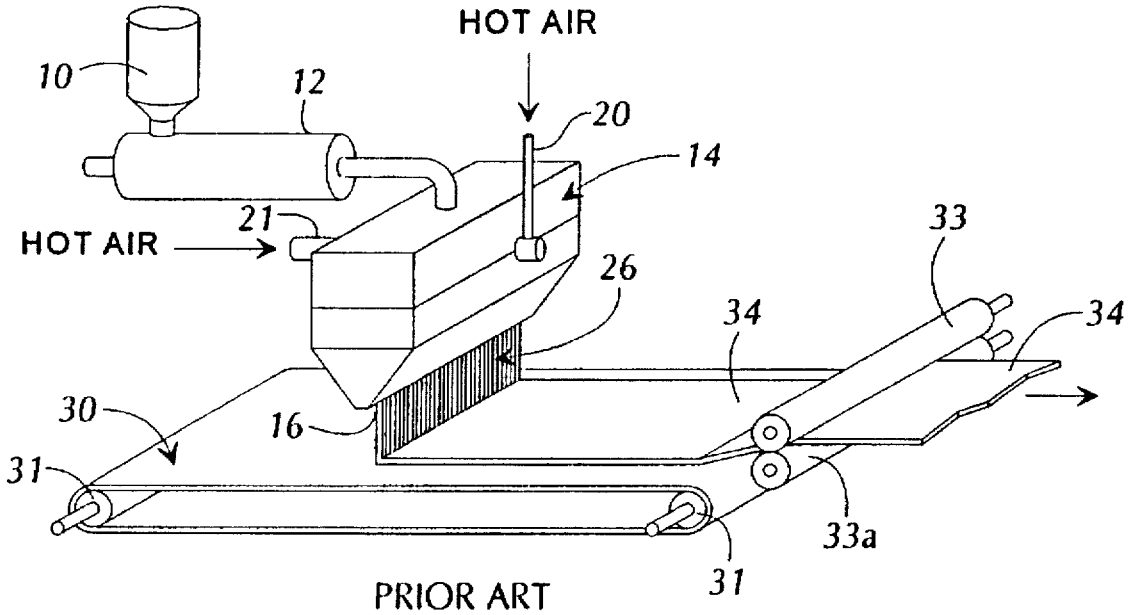
PRIOR ART FIG. 1A
FIGS. 1*a*, 1*b* and 1*c* illustrate schematic representations of a prior art apparatus for producing melt-blown fibers.
Figure 1B:
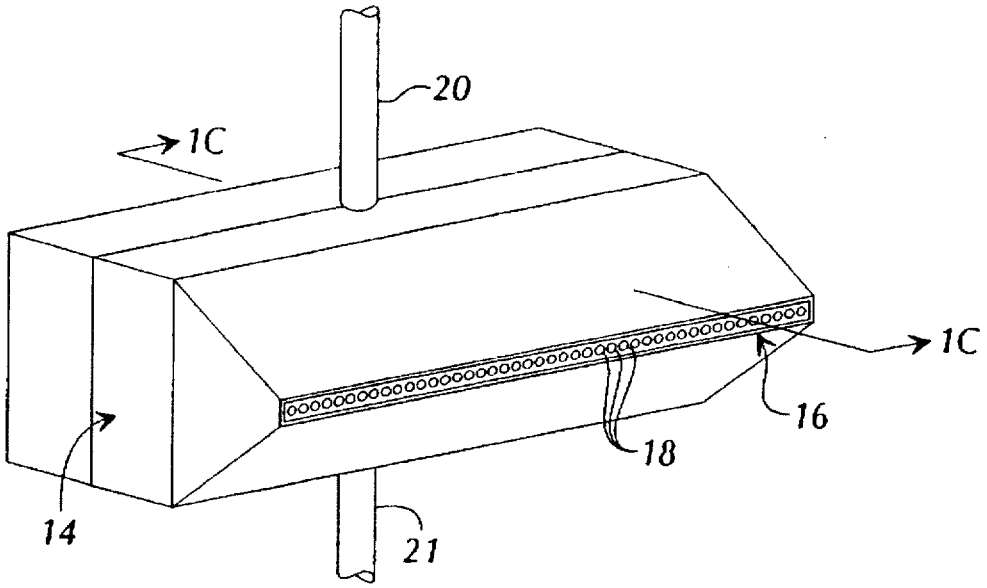
PRIOR ART FIG. 1B
Figure 1C:
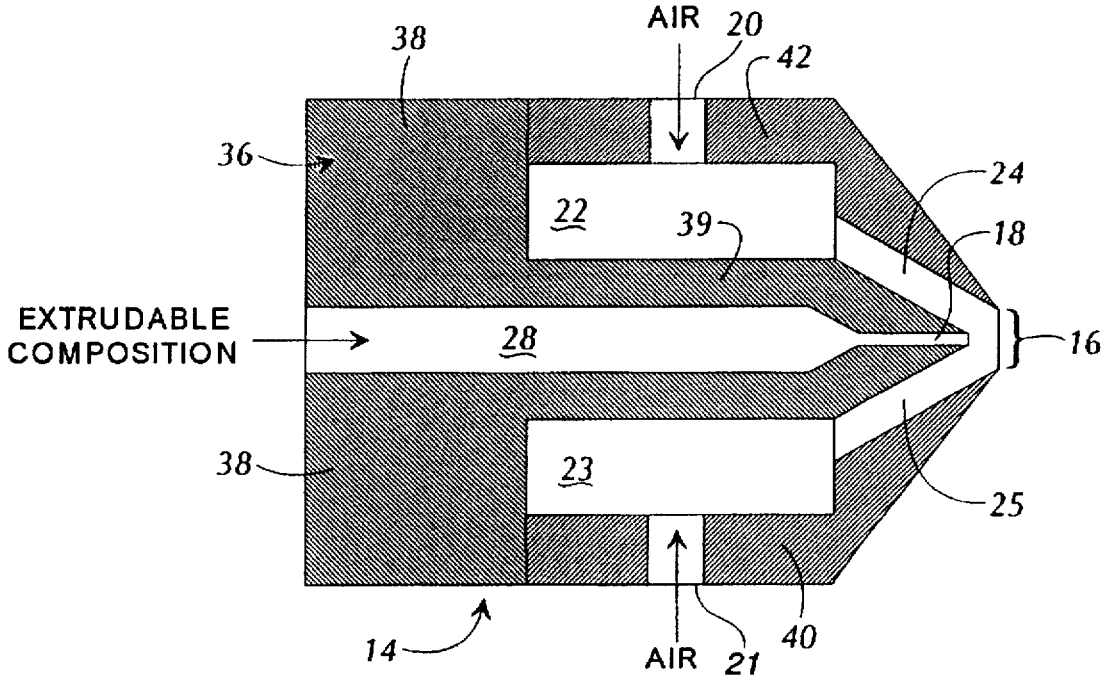
PRIOR ART FIG. 1C
Figure 2:
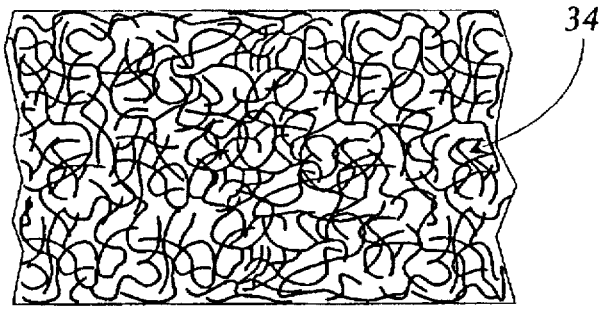
PRIOR ART FIG. 2
FIG. 2 is a surface representation of a non-woven web made in accordance with prior art methods.

The following techniques are applicable to the melt-blown, spunbond and coform fiber forming processes. For the sake of clarity, the general principles of the invention will be discussed with reference to these techniques. Following the general description of the techniques, the specific application of these techniques in the melt-blown, spunbond, and coform fields will be described. For ease in following the discussion, sub-headings are provided below; however, these sub-heading are for the sake of clarity and should not be considered as limiting the scope of the invention as defined in the claims. As used herein, the term "perturbation" means a small to moderate change from the steady flow of fluid, or the like, for example up to 50% of the steady flow, and not having a discontinuous flow to one side. Furthermore, as used herein, the term fluid shall mean any liquid or gaseous medium; however, in general the preferred fluid is a gas and more particularly air. Additionally, as used herein the term resin refers to any type of liquid or material which may be liquefied to form fibers or non-woven webs, including without limitation, polymers, copolymers, thermoplastic resins, waxes and emulsions.

GENERAL DESCRIPTION OF THE AIR FLOW PERTURBATION PROCESS

As was described previously, the production of fibers having various characteristics has been known in the prior art. However, the preferred embodiments of the present invention provide for a much greater range of variation in fiber characteristics and provide for a greater range of control for forming various non-woven web materials from such fibers. These techniques allow one to "tune in" the characteristics of the non-woven web formed thereby with little or no interruption of the production process. The basic technique involves perturbing the air used to draw the fiber from the die. Preferably, the airflow in which the fiber travels is alternately perturbed on opposite sides of an axis parallel to the direction of travel of the fiber. Thus, the airstream carrying the forming fiber is perturbed, resulting in perturbation of the fiber during formation. Airstream perturbation according to the methods and apparati of the present invention may be implemented in melt-blown and spunbond manufacturing, but is not limited to those processes.

In general, the airflow may be perturbed in a variety of ways; however, regardless of the method used to perturb the airflow, the perturbations have two basic characteristics, frequency and amplitude. The perturbation frequency may be defined as the number of pulses provided per unit time to either side. As is common the frequency will be described in Hertz (number of cycles per second) throughout the specification. The amplitude may also be described by the percentage increase or difference in air pressure $(\Delta P/P)\times 100$ in the perturbed stream as compared to the steady state. Additionally, the perturbation amplitude may be described as the percentage increase or difference in the air flow rate during perturbation as compared to the steady state. Thus, the primary variables which may be controlled by the new fiber forming techniques are perturbation frequency and perturbation amplitude. The techniques described below easily control these variables. A final variable which may be changed is the phase of the perturbation. For the most part, a 180° phase differential in perturbation is described below (that is, a portion of the airflow on one side of an axis parallel to the direction of flow is perturbed and then the other side is alternately perturbed); however, the phase differential could be adjusted between 0° to 180° to achieve any desired result. Tests have been conducted with the perturbation being symmetric (in phase) and with varying phase relationships. This variation allows for still more control over the fibers made thereby and the resulting web or material.

The perturbation of the air stream and fibers during formation has several positive effects on the fiber formed thereby. First, the particular characteristics of the fiber such as strength and crimp may be adjusted by variation of the perturbation. Thus, in non-woven web materials, increased bulk and tensile strength may be obtained by selecting the proper perturbation frequency and amplitude. Increased crimp in the fiber contributes to increased bulk in the non-woven web, since crimped fibers tend to take up more space. Additionally, preliminary investigation of the characteristics of meltblown fibers made in accordance with the present invention, as compared to those made with prior art techniques, appears to indicate that fibers made in accordance with the present invention exhibit different crystalline and heat transfer characteristics. It is believed that such differences are due to heat transfer effects (including quenching) which result from the movement of fibers in a turbulent airflow. It is further believed that such differences contribute to the enhanced characteristics of fibers and non-woven materials made in accordance with the techniques of the present invention. Additionally, the perturbation of the airflow also results in improved deposition of the fibers on the forming substrate, which enhances the strength and other properties of the web formed thereby.

Furthermore, since the variables of frequency and amplitude of the perturbation are easily controlled, fibers of different characteristics may be made by changing the frequency and/or amplitude. Thus, it is possible to change the character of the non-woven web being formed during processing (or "on the fly"). By this type of adjustment, a single machine may manufacture non-woven web fabrics having different characteristics required by different product specification while eliminating or reducing the need for major hardware or process changes, as is discussed above. Additionally, the present invention does not preclude the use of conventional process control techniques to adjust the fiber characteristics.

Figure 4:
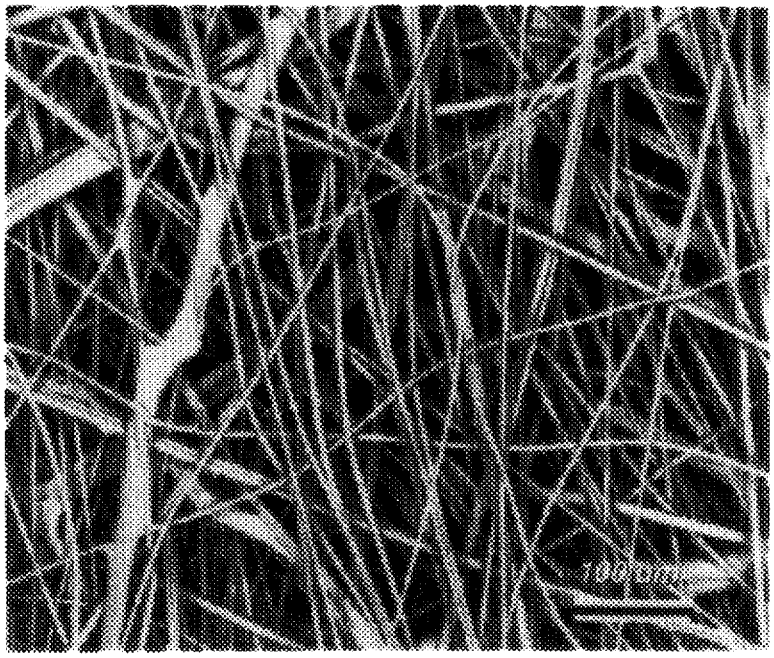
FIG. 4 is a photograph of a surface of a non-woven web manufactured without airstream perturbation.
Figure 5:
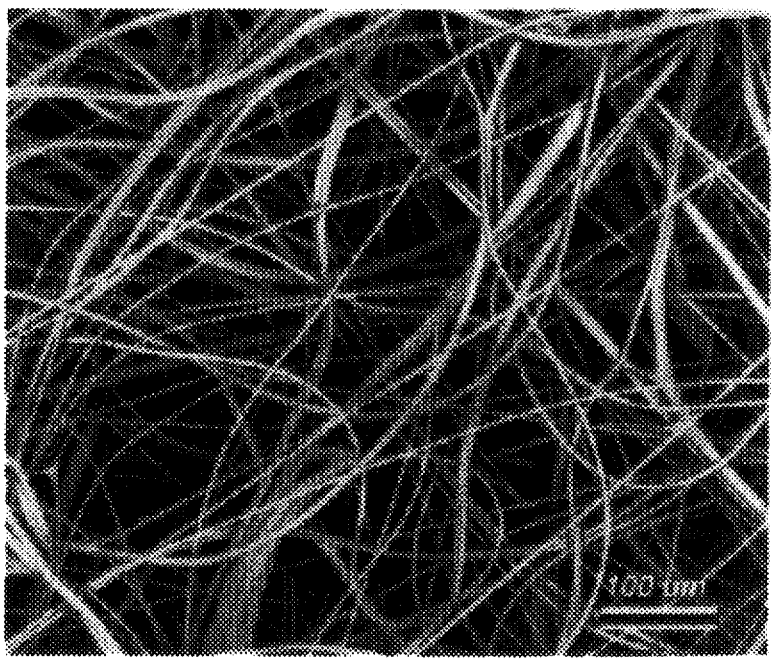
FIG. 5 is a photograph of a surface of a non-woven web manufactured in accordance with the present invention.

Referring now to FIGS. 4 and 5, magnified photographs of melt-blown webs made in accordance with prior art techniques (FIG. 4) and according to the present invention (FIG. 5) may be compared. As is seen in FIG. 4, the individual fibers of the web are relatively linear. However, as is seen in FIG. 5, the fibers in the web made in accordance with the perturbation techniques of the present invention are much more crimped and are not predominantly aligned in the same direction. Thus, as will be seen in the results described below, webs made in accordance with the present invention tend to exhibit greater bulk for a given weight and frequently have greater machine and cross direction strengths (the machine direction is the direction of movement, relative to the forming die, of the substrate on which the web is formed; the cross direction is perpendicular to the machine direction). It is believed that the increased crimp will provide many more points of contact for the fibers of the web which will enhance web strength. As a note, at first glance it would appear that many more and larger voids are present in the web of FIG. 5 as compared to that of FIG. 4; however, in fact, the web of FIG. 5 does not contain more or larger voids than that of FIG. 4. Since the SEM photographs of these Figures present views of the top surface of the material, the increased bulk of the web of FIG. 5 is not seen in the photograph and the bulk manifests in a manner to make it appear that there are a greater number of larger voids. Conversely, since the web of FIG. 4 has less bulk, a greater number of fibers of that web are located in the plane of the photograph, giving the appearance of fewer and smaller voids. As is seen below, the barrier properties of webs made in accordance with the present invention can be selected to be superior to those made in accordance with the prior art, thus demonstrating that the appearance of voids in the photograph of FIG. 5 is misleading.

Melt-Blown Applications

FIGS. 6*a* through 6*d* illustrate various embodiments of the present invention which utilize alternating air pulses to perturb air flow in the vicinity of the exit of a melt-blown die 59. Each melt-blown embodiment of the present invention includes diametrically opposed plenum/manifolds 22 and 23 and air passages 24 and 25 which lead to a tip of the melt die 59 to create a stream of fibers in a jet stream 26. The function of the present invention is to maintain a steady flow and to superimpose an alternating pressure perturbation on that steady flow near the tip of melt die 59 by alternatingly increasing or reducing the pressure of the manifolds 22 and 23. This technique assures controlled modifications in the gas borne stream of fibers 26 and therefore facilitates regularity of pressure fluctuations in the gas borne stream of fibers. Additionally, the relatively high steady state air flow with respect to perturbation air flow amplitude also serves to prevent the airborne stream of fibers from becoming tangled on air plates 40 and 42. The jet structure air entrainment rate (and therefore quenching rate) and fiber entanglement are thus modified favorably.

Figure 6B:
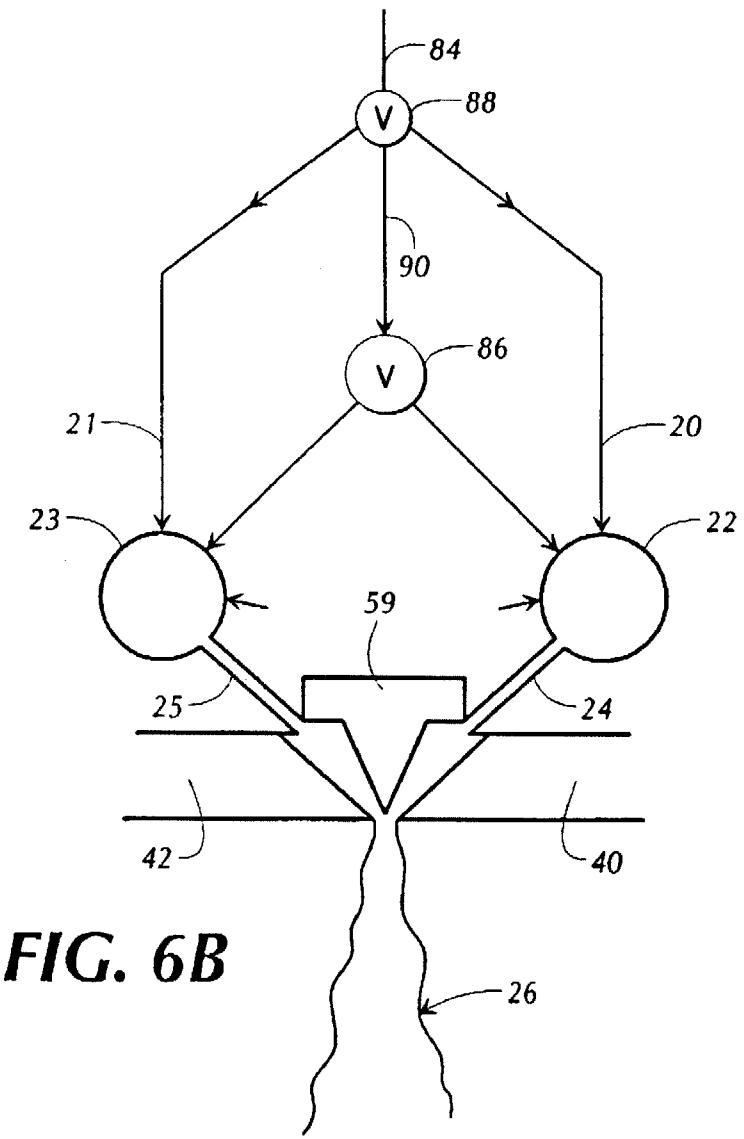
FIGS. 6*a*, 6*b*, 6*c* and 6*d* illustrate schematic representations of apparati for producing melt-blown fibers according to the present invention.
Figure 6A:
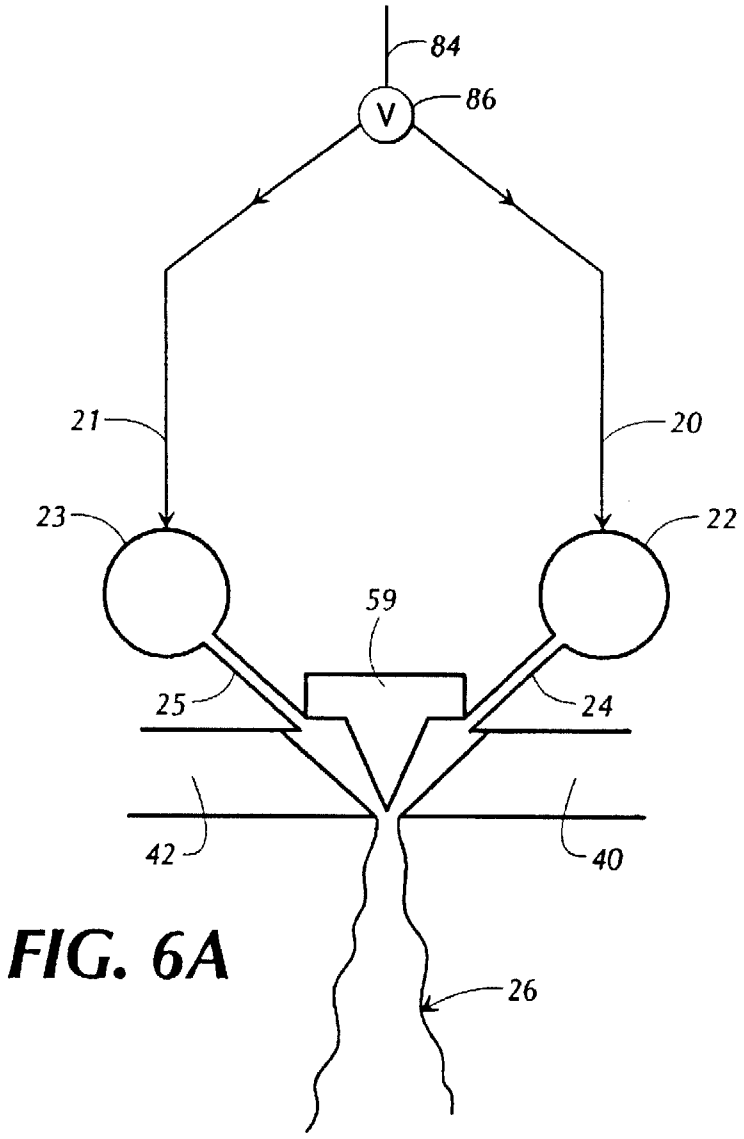
Figure 6D:
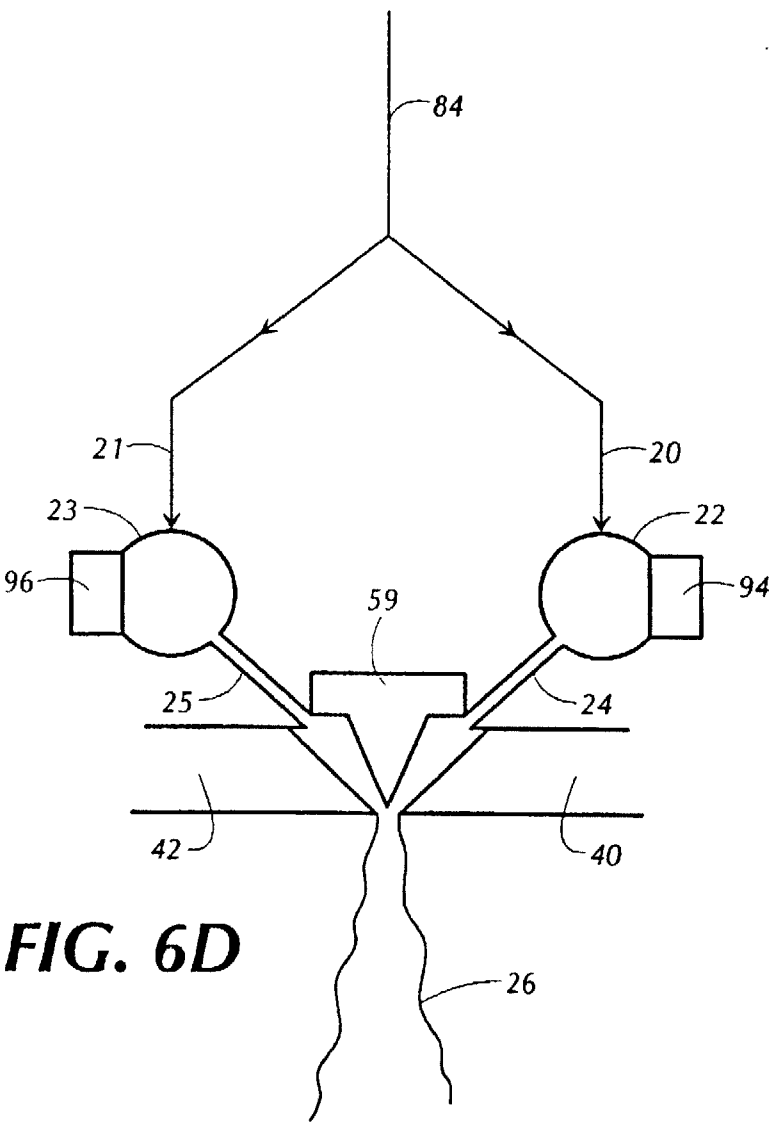
Figure 6C:
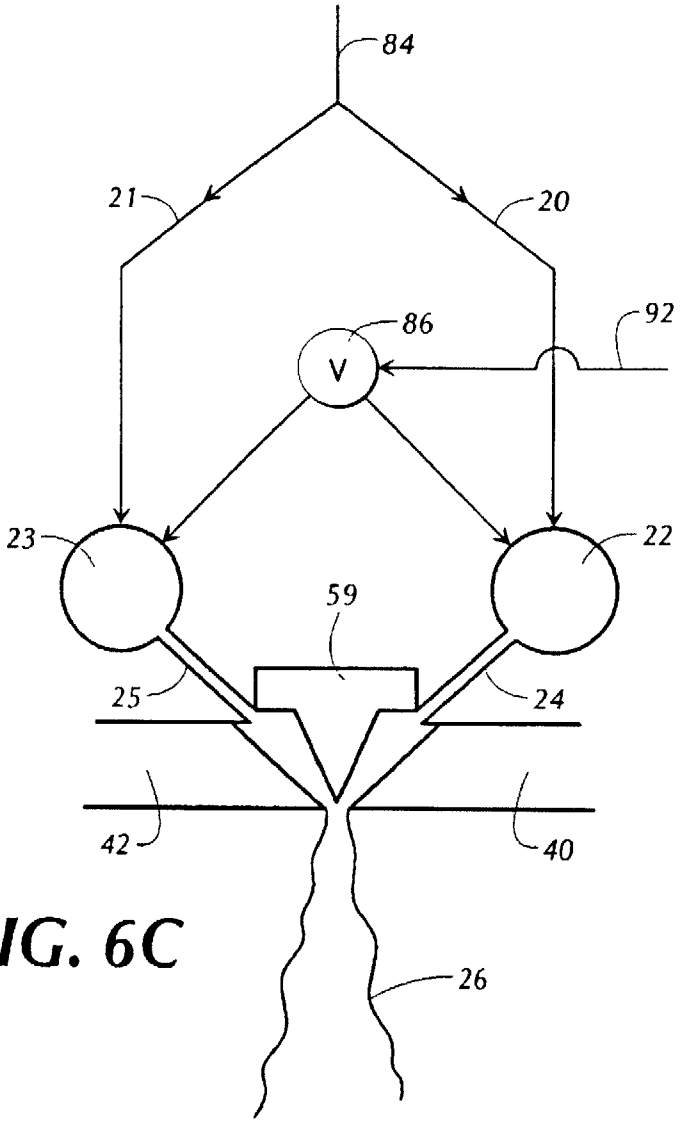
Figure 7A:
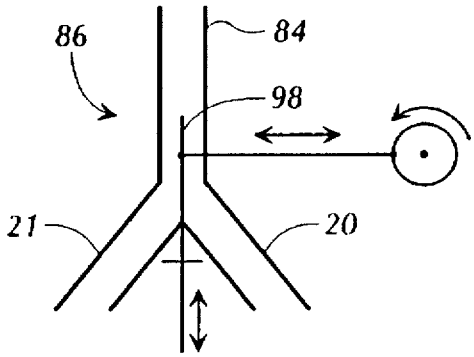
FIGS. 7*a*, 7*b*, 7*c*, 7*d* and 7*e* illustrate schematic representations of three-way valve embodiments which may be utilized in accordance with the present invention.

FIGS. 7*a* through 7*d* illustrate a few examples of valves that alternatingly augment the pressure in plenum chambers 22 and 23 shown in FIGS. 6*a*–6*d*. Referring to FIG. 7*a*, perturbation valve 86 is essentially comprised of a bifurcation of main air line 84 into inlet air lines 20 and 21. In the immediate vicinity of the bifurcation, a pliant flapper 98 alternatingly traverses the full or partial width of the bifurcation. This provides a means for alternatingly restricting air flow to one of air inlet lines 20 and 21 thereby superimposing a fluctuation in air pressure in manifolds 22 and 23. Alternatively, an activator may mechanically oscillate the flapper across the bifurcation to produce the appropriate fluctuation in air pressure in plenums 22 and 23. Flapper valve 98 may traverse the bifurcation of mainline 84 in an alternating manner simply by the turbulence of air in mainline 84 using the natural frequency of the flapper. Oscillation frequency of valve 86 as disclosed in FIG. 7*a* may be varied mechanically by an activator which reciprocates the flapper, or by simply adjusting the length of the flapper 98 to change its natural frequency.

Figure 7B:
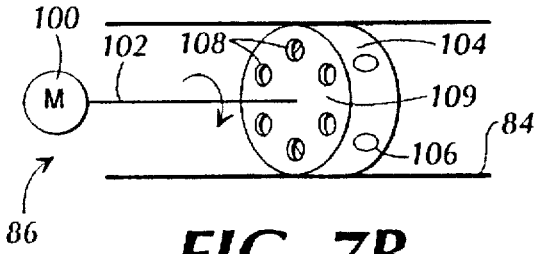

FIG. 7*b* illustrates a second embodiment of the perturbation valve 86. This embodiment may include a motor 100 which rotates a shaft 102. The shaft 102 may be fixed to a rotation plate 109 which has a plurality of apertures 108 disposed thereon. Behind rotation plate 109 is a stationary plate 104 containing a plurality of apertures 106. Both disks may be mounted so that flow is realized through fixed disk openings only when apertures from the rotation plate 109 are aligned with apertures in the stationary plate 104. The apertures on each plate may be arranged such that a steady flow may be periodically augmented when apertures on each plate are aligned. The frequency of the augmented flow may be controlled through a speed control of motor 100.

Figure 7C:
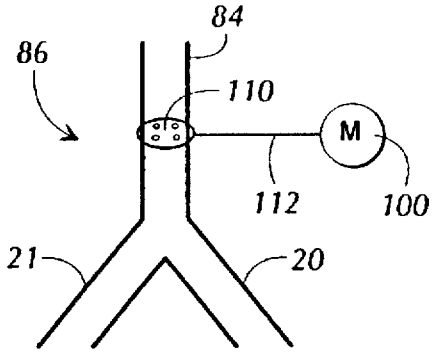

FIG. 7*c* illustrates yet another embodiment of perturbation valve 86. In this embodiment a motor 100 is rotatingly coupled to a shaft 112 which supports a butterfly valve 110 having essentially a slightly smaller cross-section than main air line 84. Turbulence created downstream from rotating butterfly 110 may then provide an alternatingly augmented air pressure in air inlet lines 20 and 21 and also in air plenums 22 and 23 to achieve the flow conditions in accordance with the present invention.

Figure 7D:
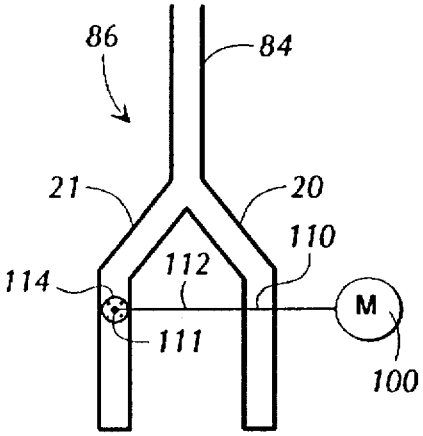

FIG. 7*d* represents yet another embodiment of a perturbation valve 86 in accordance with the present invention. There, a motor 100 is coupled to a shaft 112 and butterflies 110 and 114 within inlet air lines 20 and 21 respectively. As is seen from FIG. 7*d*, butterflies 110 and 114 are mounted on shaft 112 approximately 90° to each other. Additionally, each of the butterflies 110 and 114 may include apertures 111 so as to provide a constant air flow to each of the plenums while alternatingly augmenting pressure in each of the plenums 22 and 23 when the appropriate butterfly is in an open position.

Figure 7E:
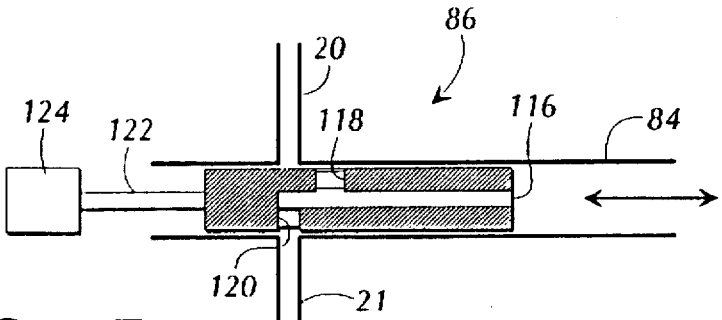

FIG. 7*e* represents still another embodiment of the perturbation valve 86. In this embodiment an actuator 124 is coupled to a shaft 122 which in turn is mounted to a spool 123. Spool 123 includes channels 118 and 120 which communicate with air inlet lines 20 and 21 respectively, depending on the longitudinal position of the spool 123. Each of the channels 118 and 120 is fluidly connected to main channel 116 which is fluidly connected to main air line 84. In this embodiment, perturbation valve 86 may achieve alternatingly augmented air pressures in each of the plenums by reciprocation of rod 122 from actuator 124. Additionally, channels 118 and 120 may simultaneously be connected to main air line 84 while activator 124 reciprocates spool 123 to vary an amount of overlap, and thus air flow restriction, between channels 118 and 120 with lines 20 and 21, respectively, to achieve alternating augmented pressures in the plenum chambers 22 and 23, respectively. Actuator 124 may include any known means for achieving such reciprocation. This may include but is not limited to pneumatic, hydraulic or solenoid means.

Figure 8A:
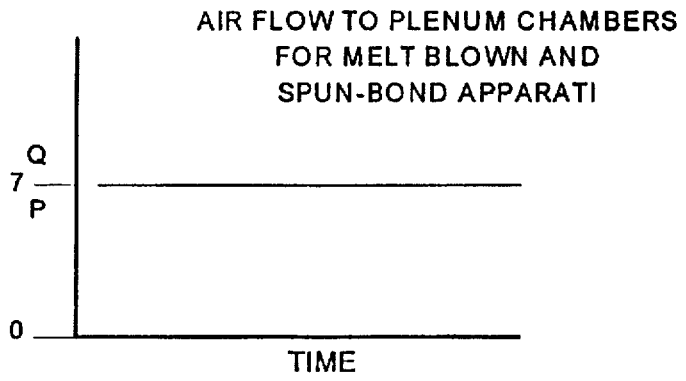
PRIOR ART FIG. 8A
FIGS. 8*a* and 8*d* illustrate plenum pressure as a function of time for a prior art apparatus for producing melt-blown fibers.
Figure 8B:
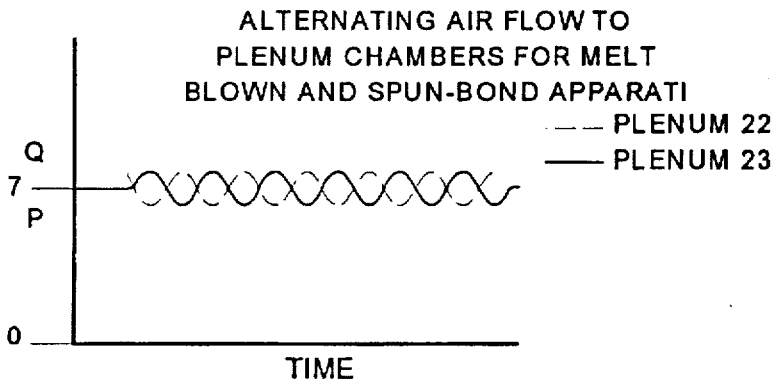
PRIOR ART FIG. 8B
FIGS. 8*b* and 8*c* illustrate plenum pressure as a function of time for an apparatus for producing melt-blown fibers in accordance with the present invention.
Figure 8C:
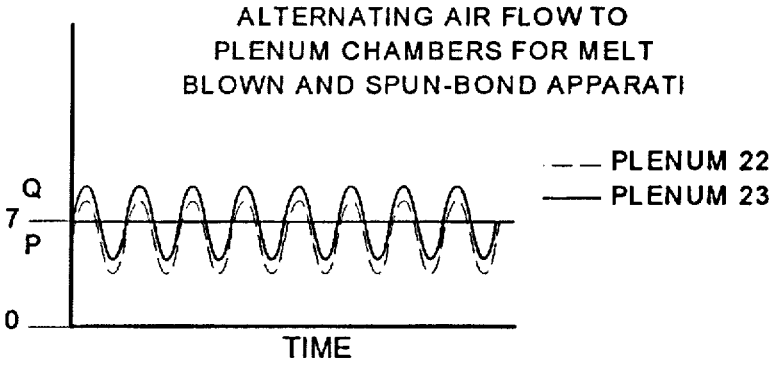
PRIOR ART FIG. 8C
Figure 8D:
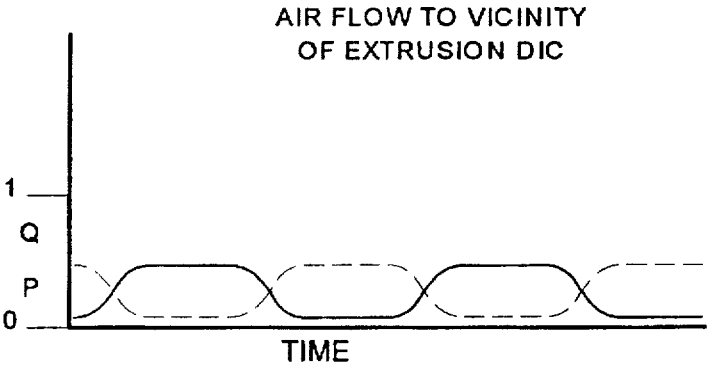
PRIOR ART FIG. 8D

FIGS. 8*a*–8*d* illustrate, respectively, plenum air pressures in both the prior art melt-blown apparatus and in the melt-blown apparatus according to the present invention. As is seen in FIG. 8*a*, a prior art air pressure in the plenum chambers is essentially constant over time whereas in FIGS. 8*b* and 8*c* the air pressure in the plenum chambers is essentially augmented in an oscillatory manner. As an example, the point at which the mean pressure intersects the ordinate can be about 7 psig. FIG. 8*d* illustrates a prior art air pressure in the vicinity of a prior art extrusion die where air is turned on and off. In this case, the mean pressure meets the ordinate at about 0.5 psig, for example. The on/off control of prior art air flow as illustrated in FIG. 8*d* is conducive to die clogging due to the intermittent flow, as explained above. Additionally, the prior art on/off air flow control illustrated in FIG. 8*d* (implemented by Shambaugh) utilizes a lower average pressure, a lower frequency and less pressure amplitude than the present invention. Although the airflow characteristic illustrated in FIG. 8*a* is not conducive to die clogging, no control may be implemented over fiber crimping or web characteristics, since the flow is virtually constant with respect to time.

Perturbation valve 86 may be placed in a multitude of arrangements to achieve the alternatingly augmented flow in plenum chambers 22 and 23 of the melt-blown apparatus according to the present invention. For example, FIG. 6*b* shows another embodiment according to the present invention. In this embodiment, main air line 84 bifurcates constant air flow to inlet air lines 20 and 21 while bleeding an appropriate flow of air to perturbation valve 86 via bleeder valve 88 and line 90. Therefore, in this embodiment plenum chambers 23 and 22 each include two inlets. The first inlet introduces essentially constant flow from air inlet lines 20 and 21. The second inlet of each plenum chamber introduces the alternating flow to the chamber, thereby superimposing oscillatory flow on the constant flow from lines 20 and 21. The amount of air bled from bleeder valve 88 will control the amplitude of the pressure augmentation for precise adjustment of fiber characterization, as explained in greater detail below, while perturbation valve 86 controls frequency.

FIG. 6*c* represents yet another embodiment of the present invention. In this embodiment, main air line 84 bifurcates into air lines 21 and 20 to supply air pressure to plenum chambers 22 and 23. Additionally, an auxiliary air line 92 bifurcates at perturbation valve 86. The perturbation valve 86 then superimposes an alternatingly augmented air pressure onto plenum chambers 22 and 23 to achieve the oscillatory flow conditions in accordance with the present invention. Here, pressure on the air line 92 controls the amplitude of air pressure perturbation, while perturbation valve 86 controls perturbation frequency, as explained above.

FIG. 6*d* represents yet another embodiment of the present invention. In this embodiment, main air line 84 bifurcates into inlet air lines 20 and 21 which lead to plenum chambers 22 and 23 respectively. The alternatingly augmented pressure in plenum chambers 22 and 23 may be provided by transducers 94 and 96 respectively. Transducers 94 and 96 are actuated by means of an electrical signal. For example, the transducers may actually be large speakers which receive an electrical signal to pulsate 180° out of phase in order to provide the alternating augmented pressures in plenum chambers 22 and 23. However, any type of appropriate transducer may create an augmented air flow by using any means of actuation. This may include but is not limited to electromagnetic means, hydraulic means, pneumatic means or mechanical means.

As was discussed previously, all of the described embodiments allow for the precise control of the perturbation frequency and amplitude, preferably without interrupting the operation of the fiber forming machinery. As will be described below, this ability to precisely control the perturbation parameters allows for relatively precise control of the characteristics of the fibers and web formed thereby. Typically, there are a wide variety of fiber parameters and while a particular set of parameters may be desired for making one type of non-woven material, such as filter material, a different set of fiber parameters may be desired for making a different type of material, such as for disposable garments.

For example, in filter applications, the material is preferably made of small diameter fibers. However, larger diameter fibers may be desired for other materials. Furthermore, many end products consist of layers of material having a variety of characteristics. For example, disposable diapers generally consist of a wicking layer designed to move moisture away from contact with the skin of an infant and to keep such moisture away. A middle, absorbent layer is used to retain the moisture. Finally, an outer, barrier layer is desired to prevent the absorbed moisture from seeping out of the diaper. The fiber characteristics for each layer of the diaper are different in order to achieve the specific functions of each type of material. With the present techniques, various portions of the web can be formed by varying the perturbation parameters with respect to time so that each layer of the diaper is formed sequentially in one non-woven web. Then the single web may be folded to provide the layered finished material.

Thus, with precise control of the fiber and material characteristics by control of the perturbation characteristics, a great degree of flexibility is possible in the formation of non-woven webs. This control, in turn, allows for greater efficiency and the ability to design a greater range of materials which may be produced with little interruption of the production process.

One shortcoming of prior art melt-blown equipment is the relative inability to precisely control the diameter of fibers produced thereby. The formation of materials with particular characteristics often requires precise control over the diameter of the fibers used to form the non-woven web. With the perturbation technique of the present invention, it is possible to provide for much less variation in fiber diameter than was previously possible with prior art techniques.

Figure 9:
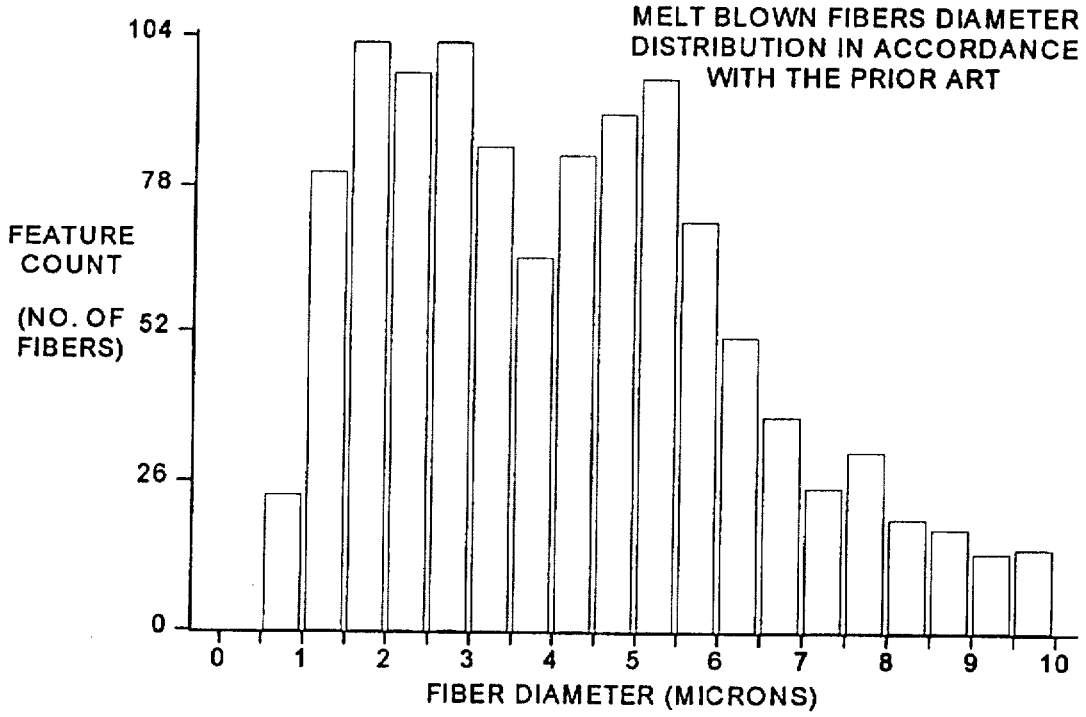
PRIOR ART FIG. 9
FIG. 9 illustrates fiber diameter distribution for melt-blown fibers manufactured in accordance with the prior art.
Figure 10:
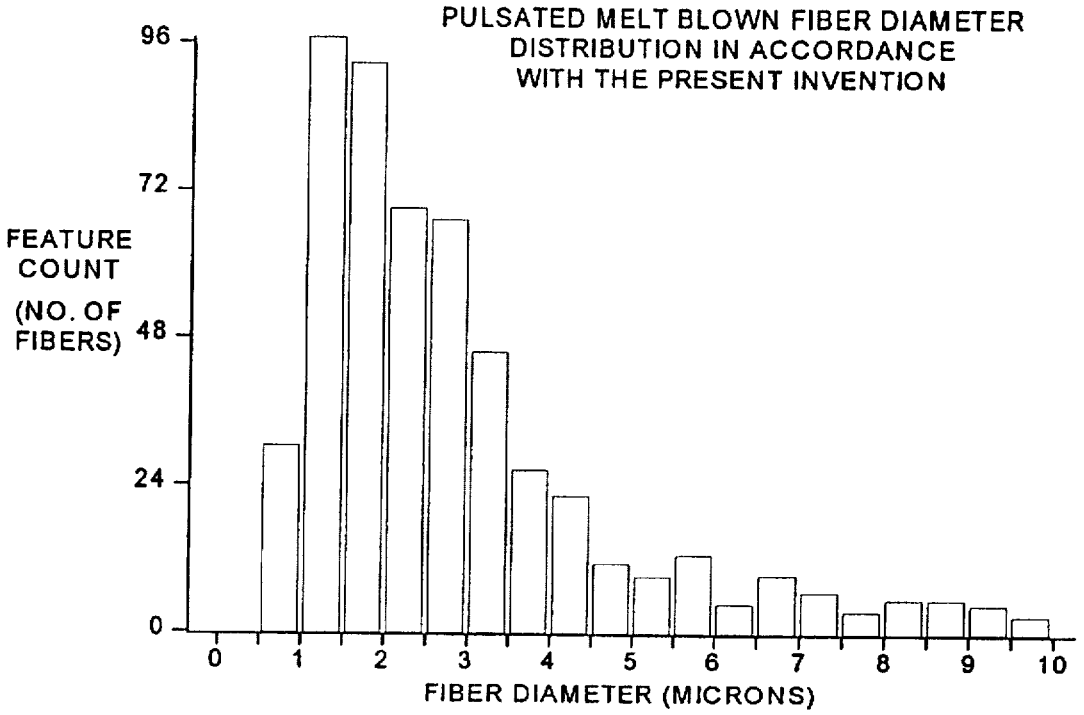
FIG. 10 illustrates fiber diameter distribution for melt-blown fibers manufactured in accordance with the present invention.

FIGS. 9 and 10 illustrate fiber diameter distribution for samples taken from prior art melt-blown techniques and the melt-blown fiber producing technique according to the melt-blown apparatus embodiment of FIG. 6*c*. FIG. 9 shows a diameter distribution in accordance with the prior art. FIG. 10 represents a fiber diameter distribution chart for melt-blown fibers made in accordance with the inventive technique. The fiber distribution in FIG. 10 illustrates a fiber diameter sample which has a distribution that is centered on a peak between about 1 and 2 microns. Here, the narrow band of fiber distribution achieved by the perturbation method and apparatus illustrates the great extent to which fiber diameter may be controlled by only varying perturbation frequency or amplitude.

Figure 11:
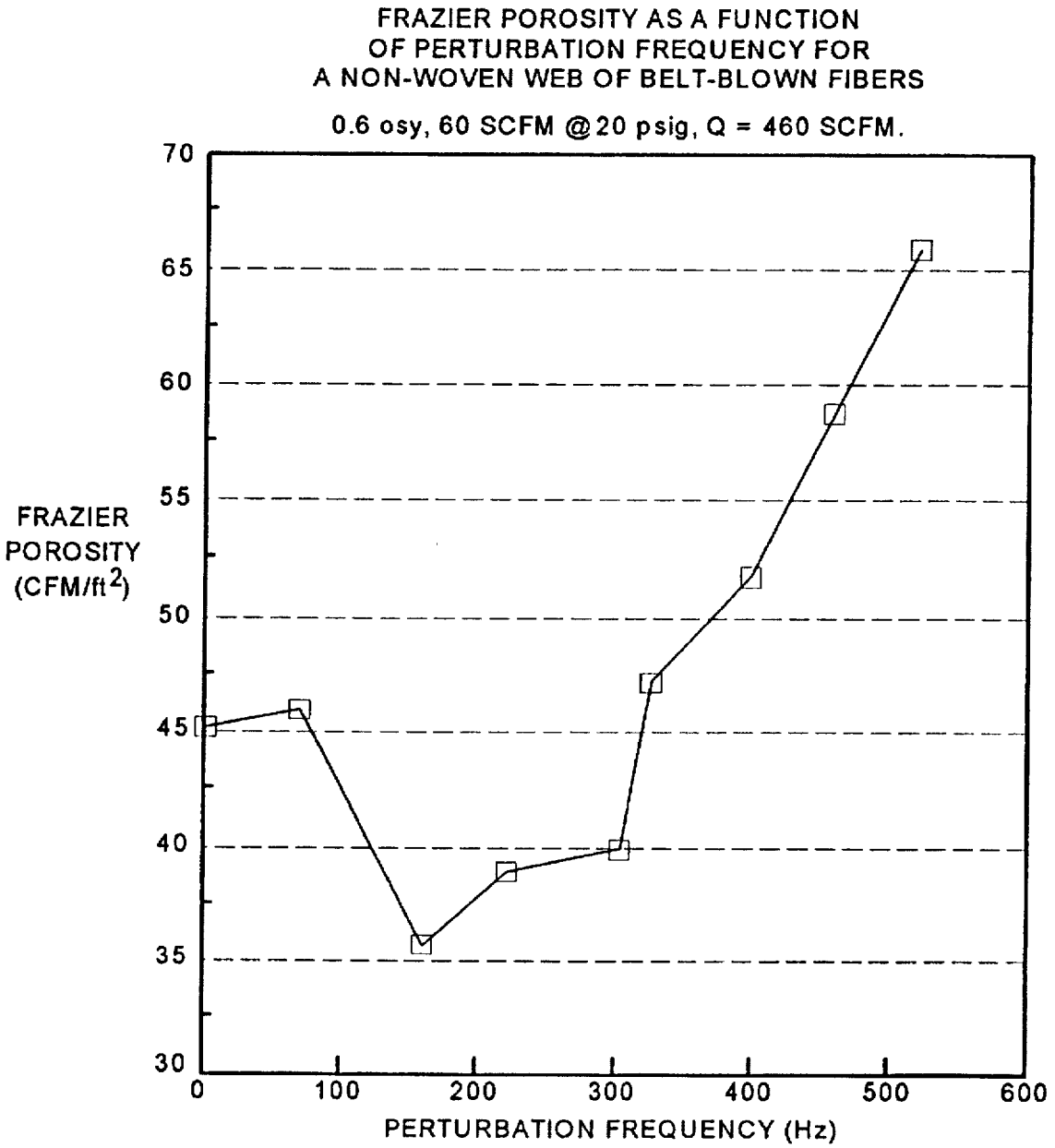
FIG. 11 illustrates Frazier porosity as a function of perturbation frequency for a melt-blown non-woven web manufactured in accordance with the present invention.

FIG. 11 represents the Frazier porosity of a non-woven melt-blown web made in accordance with the present invention as a function of perturbation frequency in the plenum chambers 22 and 23. The Frazier Porosity is a standard measure in the non-woven web art of the rate of airflow per square foot through the material and is thus a measure of the permeability of the material (units are cubic feet per square foot per minute). For all samples the procedure used to determine Frazier air permeability was conducted in accordance with the specifications of method 5450, Federal Test Methods Standard No. 191 A, except that the specimen sizes were 8 inches by 8 inches rather than 7 inches by 7 inches. The larger size made it possible to ensure that all sides of the specimen extended well beyond the retaining ring and facilitated clamping of the specimen securely and evenly across the orifice.

As is illustrated in FIG. 11, the Frazier porosity generally falls first to a minimum and then increases with perturbation frequency from a steady state to approximately 500 hertz. Thus, one can observe that to make a material with a desired Frazier porosity with the present invention, it is only necessary to vary the oscillation frequency (and/or the amplitude). With prior art techniques, changes in porosity often required changes to the die or starting materials or the duplication of machinery. Thus, with the present techniques, it is possible to easily change the porosity of a material once a run is completed; it is only necessary to adjust the perturbation frequency (or amplitude), which can easily be done with simple controls and without stopping production. Therefore, the melt-blowing apparati according to the present invention may quickly and easily manufacture filtering materials of varying porosity by simply changing perturbation frequency.

Figure 12:
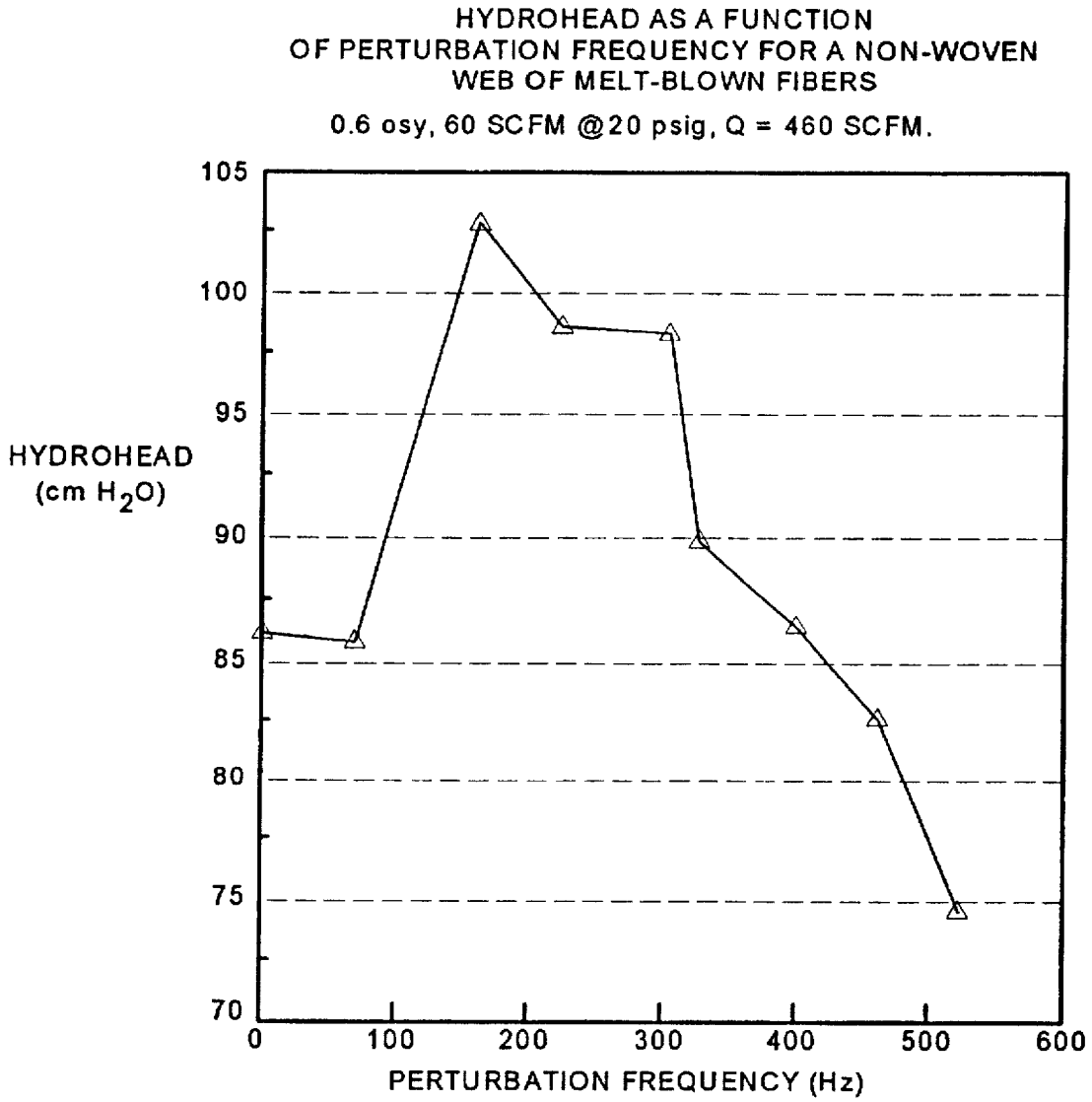
FIG. 12 illustrates hydrohead as a function of perturbation frequency for a melt-blown non-woven web manufactured in accordance with the present invention.

FIG. 12 illustrates a plot of hydrohead as a function of perturbation frequency. The Hydrohead Test is a measure of the liquid barrier properties of a fabric. The hydrohead test determines the height of water (in centimeters) which the fabric will support before a predetermined amount of liquid passes through. A fabric with a higher hydrohead reading indicates it has a greater barrier to liquid penetration than a fabric with a lower hydrohead. The hydrohead test is performed according to Federal Test Standard No. 191A, Method 5514. Generally, hydrohead first increases and then decreases with increasing perturbation frequency in a frequency range of approximately 75 hertz to 525 hertz. Since perturbation frequency directly affects hydrohead, an appropriate adjustment of the perturbation valve 86 provides the type of barrier to liquid required by a particular application. Perturbation frequency may be used to vary hydrohead to suit the particular use for the material.

EXAMPLES

The following examples provide a basis for demonstrating the advantages of the present invention over the prior art in the production of melt-blown, coform and spunbond webs and materials. These examples are provided solely for the purpose of illustrating how the methods of the present invention may be implemented and should not be interpreted as limiting the scope of the invention as set forth in the claims.

Example 1

Process Condition

Die Tip Geometry:

Recessed

Die Width=20"

Gap=0.090"

30 hpi

Primary Airflow:

Heated (≈608° F. in heater)

488 scfm

Pressure $P_T$=6.6 psig

Auxiliary Airflow:

Unheated (ambient air temp.)

60 scfm

Inlet Pressure=20 psig

Polymer:

Copolymer of butylene and propylene polypropylene*—79% polybutylene—20% blue pigment—01%

*800 MFR polypropylene coated with peroxide—final MFR≈1500

Polymer Throughput: 0.5 GHM

Melt Temperature: 470° F.

Perturbation Frequency: 0 Hz, 156 Hz, 462 Hz

Basis Weight: 0.54 oz/yd$^2$

Forming Height: 10"

Test Results

Barrier

TABLE 1-1

| Perturbation Frequency | 0 Hz | 156 Hz | 462 Hz |
|---|---|---|---|
| Frazier Porosity (cfm/ft$^2$) | 45.18 | 35.70 | 65.89 |
| Hydrohead (cm) | 86.40 | 103 | 74.60 |

In this example, the melt-blown process was configured as described above and corresponds to the embodiment shown in FIG. 6c, in which the primary airflow is supplemented with an auxiliary airflow. In the example, the unit hpi characterizes the number of holes per inch present in the die. $P_T$ is defined as the total pressure measured in a stagnant area of the primary manifold. GHM is defined as the flow rate in grams per hole per minute; thus, the GHM unit defines the amount, by weight, of polymer flowing through each hole of the melt-blown die per minute. As discussed above, Frazier Porosity is a measure of the permeability of the material (units are cubic feet per minute per square foot). The hydrohead, measured as the height of a column of water supported by the web prior to permeation of the water into the web, measures the liquid barrier qualities of the web.

The above configuration and results provide a baseline comparison of a typical melt-blown production run with no air perturbation (a frequency of perturbation of 0 Hz) with runs conducted with perturbation frequencies of 156 and 462 Hz. As can be seen from Table 1-1, in general, the barrier characteristics of materials made using perturbed airflows improve with increasing perturbation frequency. Thus, by merely varying the perturbation frequency, a relatively easy process, materials or webs with desired barrier characteristics may be made without major changes to the process conditions. This ability to adjust barrier properties was not previously possible in the prior art without substantial changes to the process conditions which required significant time and effort. As can be seen there is an initial decrease in Frazier Porosity (which represents an decrease in the permeability of the web or material to air) at the 156 Hz perturbation frequency. Similarly, at the 156 Hz frequency, there is an increase in the supported hydrohead. Thus, at the 156 Hz frequency, the web material produced is a more effective barrier. At the 462 Hz perturbation frequency, the Frazier Porosity has increased and the Hydrohead has decreased from both the 0 Hz (prior art) and 156 Hz production runs. Thus, at the higher perturbation frequency, the web material is a less effective barrier, but is more suitable for use as an absorbent or wicking material.

The change in barrier properties with respect to change in perturbation frequency is also demonstrated in FIGS. 11 and 12 (for different process conditions from those of Example 1). As FIG. 11 shows, there is an initial drop in Frazier Porosity as the process is changed from no perturbation to a perturbation frequency between 1 and 200 Hz. As the perturbation frequency is increased above about 200 Hz, the Frazier Porosity increases, until the original 0 Hz Frazier Porosity is exceeded between about 300 to 400 Hz. Above 400 Hz, the Frazier Porosity increases relatively steeply with increasing perturbation frequency. Similarly, referring to FIG. 12, supported hydrohead initially increases between about 1 to 200 Hz perturbation frequency. Then the hydrohead steadily decreases with increasing perturbation frequency until the supported hydrohead at between about 400 to 500 Hz is less than that at the 0 Hz (steady flow) frequency. Thus, as these Figures demonstrate, with no variation in the basic process conditions such as polymer type, flow conditions, die geometry, aside from a simple change in the frequency of perturbation of the airflow, a wide variety of different web materials can be made having desired barrier properties. For example, by merely setting the perturbation frequency in the 100 to 200 Hz range, with all of the other process conditions remaining unchanged, a more effective barrier material can be made. Then, if less effective barrier material is desired, the only process change necessary would be an increase in the perturbation frequency, which could be accomplished with a simple control and without necessitating the interruption of the production line. In prior art techniques, alteration of the production run barrier properties may require substantial changes in the process conditions, thereby requiring a production line shut-down to make the changes. In actuality, such changes are not typically made on a given machine; multiple machines typically produce a single type of web material (or an extremely narrow range of materials) having desired properties.

Example 2

Process Conditions

Die Tip Geometry:

Recessed

Die Width=20"

Gap=0.090"

30 hpi

Primary Airflow:

Heated (≈608° F. in heater)

317 scfm

Pressure $P_T$=2.6 psig

Auxiliary Airflow:

Unheated (ambient air temp.)

80 scfm

Inlet Pressure=20 psig

Polymer: High MFR PP*

*e.g. 800 MFR polypropylene coated with peroxide—final MFR≈1500

Polymer Throughput: 0.5 GHM

Melt Temperature: 470° F.

Perturbation Frequency: 0 Hz (control), 70 Hz

Basis Weight: 5 oz/yd$^2$

Forming Height: 10"

Test Results

In this example the bulk of the web made using a 70 Hz perturbation frequency was compared to a control web (0 Hz perturbation frequency).

Control—0.072" (thickness)

70 Hz—0.103"

Thus, it can be seen that using a modest 70 Hz perturbation frequency results in a 43% increase in bulk over the prior art. Increased bulk is often desired in the final web or material because the increased bulk often provides for better feel and absorbency.

Figure 13:
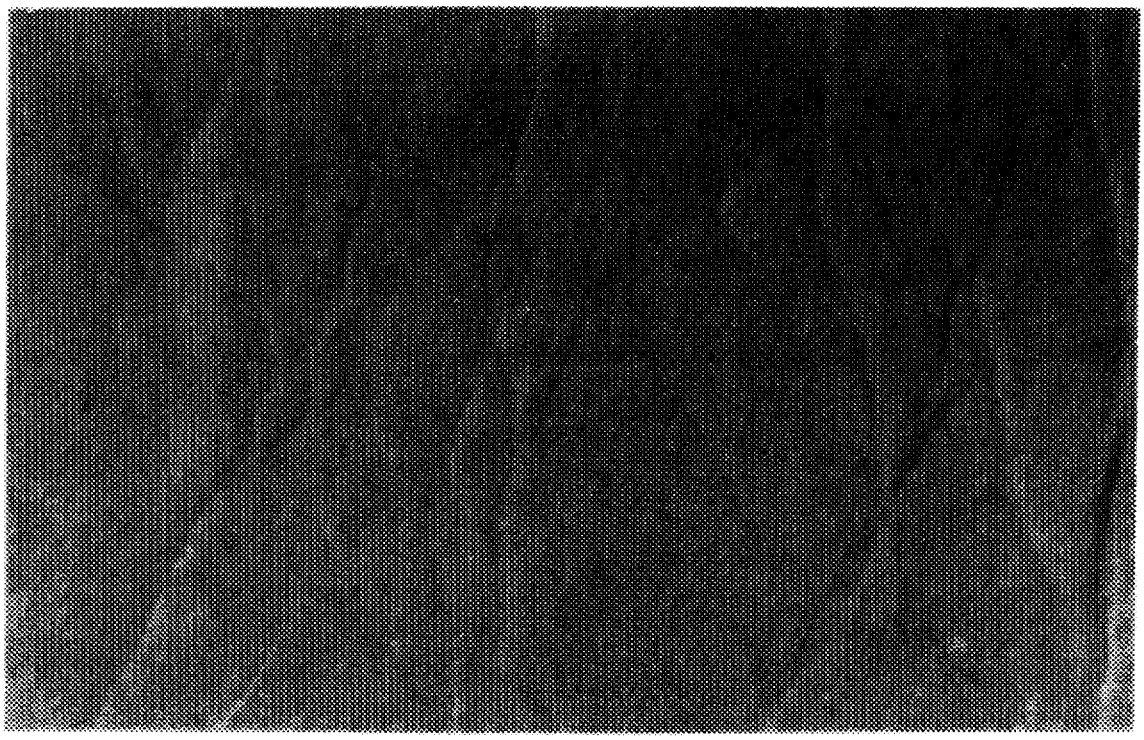
FIG. 13 is a photograph of the surface of a non-woven web manufactured in the absence of airstream perturbation.
Figure 14:
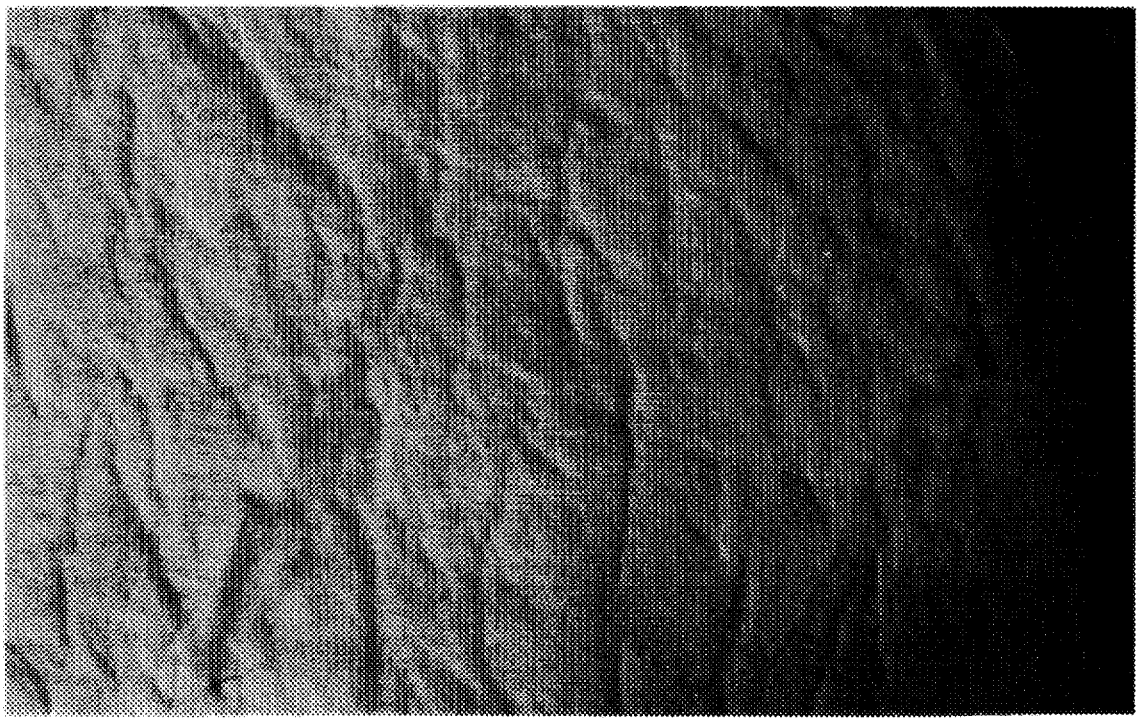
FIG. 14 is a photograph of the surface of a non-woven web manufactured in accordance with the present invention.

Furthermore, with respect to desired texture or appearance, the use of the perturbation techniques of the present invention allows for custom texture or appearance control. Referring to the photographs of FIGS. 13 and 14, FIG. 13 represents the appearance of the web produced with the 0 Hz perturbation frequency while the web of FIG. 14 represents that produced using the 70 Hz perturbation frequency. As can be seen from the Figures, the web of FIG. 14 has a leather like appearance and texture which is not present in the web of FIG. 13. Thus, to the extent such appearance and texture is desired, the techniques of the present invention allow for added control and variety in production of various types of webs having such characteristics.

Example 3

Process Conditions

Die Tip Geometry:

Recessed

Gap=0.090"

30 hpi

Primary Airflow:

Heated (≈608° F. in heater)

426 scfm

Pressure $P_T$=5 psig

Auxiliary Airflow:

Unheated (ambient air temp.)

80 scfm

Inlet Pressure=20 psig

Polymer:

High MFR PP*, 1% Blue pigment

*e.g. 800 MFR polypropylene coated with peroxide—final MFR≈1500

Polymer Throughput: 0.6 GHM

Melt Temperature: 480° F.

Perturbation Frequency: 0 Hz (control), 192 Hz, 436 Hz

Basis Weight: 0.54 oz/yd$^2$

Forming Height: 10"

Test Results

Softness—Cup Crush—0 Hz—1352 192 Hz—721

Cup Crush is a measure of softness whereby the web is draped over the top of an open cylinder of known diameter, a rod of a diameter slightly less than the inner diameter of the cup cylinder is used to crush the web or material into the open cylinder while the force required to crush the material into the cup is measured. The cup crush test was used to evaluate fabric stiffness by measuring the peak load required for a 4.5 cm diameter hemispherically-shaped foot to crush a 22.9 cm by 22.9 cm piece of fabric shaped into an approximately 6.5 cm diameter by 6.5 centimeter tall inverted cup while the cup shaped fabric was surrounded by an approximately 6.5 cm centimeter diameter cylinder to maintain a uniform deformation of the cup shaped fabric. The foot and cup were aligned to avoid contact between the cup walls and the foot which could affect the peak load. The peak load was measured while the foot was descending at a rate of about 0.64 cm/s utilizing a Model 3108-128 10 load cell available from the MTS Systems Corporation of Cary, N.C. A total of seven to ten repetitions were performed for each material and then averaged to give the reported values.

The lower cup crush number achieved by the material made using the 192 Hz perturbation frequency indicates that the material made thereby is softer. Subjective softness tests such as by hand or feel also confirm that the material made by using the 192 Hz perturbation frequency is softer than that made using the prior art techniques.

Strength

TABLE 3-1

| Perturbation Frequency | 0 Hz | 192 Hz | 436 Hz |
|---|---|---|---|
| MD Peak Load (lbs) | 1.989 | 2.624 | 2.581 |
| MD Elongation (in) | 0.145 | 0.119 | 0.087 |
| CD Peak Load (lbs) | 1.597 | 1.322 | 1.743 |
| CD Elongation (in) | 0.202 | 0.212 | 0.135 |

As can be seen from Table 3-1, the machine direction strength increases for runs in which the perturbation frequency is greater than 0 Hz. In the production runs of Example 3, the direction of perturbation was generally parallel to the machine direction (MD). Applicants believe that the increased strength in MD is due to more controlled and regular overlap in the lay-down of the web on the substrate as the fibers oscillate as a result of the perturbation. A similar result is demonstrated in FIG. 15 which is a graph showing the variation of Peak Load in MD and CD as a function of perturbation frequency. As is seen in the FIG. 15, strength in the MD increases as the perturbation frequency increases. Typically, CD strength remains relatively constant (with slight variations) regardless of perturbation frequency. It is applicants' belief that increases in CD strength can be achieved by varying the angle of the perturbation relative to the MD. Thus, by having the perturbation occur at some angle between parallel to MD and perpendicular to MD, CD strength can be improved as well as MD strength.

Barrier

TABLE 3-2

| Perturbation Frequency | 0 Hz | 192 Hz |
|---|---|---|
| Frazier Porosity ($cfm/ft^2$) | 31.5 | 22.3 |
| Hydrohead (cm of $H_2O$) | 90.8 | 121.6 |
| Equiv. Pore Diameter (μm) | 13.2 | 10.8 |

As Table 3-2 demonstrates, and as was demonstrated in Example 1, at relatively low perturbation frequencies (between about 100 to 200 Hz) the barrier properties of a web produced thereby increase. This result is explained by the measured Equivalent Circular Pore Diameter in the 0 Hz case and the 192 Hz case. As is shown in Table 3-2, the pore size for web material produced using a 192 Hz perturbation frequency is 2.4 microns less than that for a material produced with no perturbation. Thus, since the pores in the material are smaller, the permeability of the material is less and the barrier properties are greater.

Example 4

Process Conditions

Die Tip Geometry:

Recessed

Die Width=20"

Gap=0.090"

30 hpi

Primary Airflow:

Heated (≈608° F. in heater)

422 scfm

Pressure PT=5 psig

Auxiliary Airflow:

Unheated (ambient air temp.)

40 scfm

Inlet Pressure=15 psig

Polymer:

Copolymer of butylene and propylene polypropylene*—79% polybutylene—20% blue pigment—01%

*800 MFR polypropylene coated with peroxide—final MFR=1500

Polymer Throughput: 0.6 GHM

Melt Temperature: 471° F.

Perturbation Frequency: 0–463 Hz

Basis Weight: 0.8 $oz/yd^2$

Forming Height: 12"

Test Results

Barrier

TABLE 4-1

| Perturbation Frequency | 0 Hz | 305 Hz | 463 Hz |
|---|---|---|---|
| Frazier Porosity ($cfm/ft^2$) | 46.27 | 26.85 | 59.34 |

Once again, it can be seen that the porosity of the web material initially decreases when the airflow is perturbed. However, as the perturbation frequency increases, the porosity also increases. The results in Example 4 agree with the other barrier property results from the other examples and with the results reported in FIGS. 11 and 12.

Although the above referenced examples utilize a polypropylene or mixture of high melt flow polypropylene and polybutylene resins for non-woven web production, a multitude of thermoplastic resins and elastomers may be utilized to create melt-blown non-woven webs in accordance with the present invention. Since it is the structure of the web of the present invention which is largely responsible for the improvements obtained, the raw materials used may be selected from a wide variety. For example, and without limiting the generality of the foregoing, thermoplastic polymers such as polyolefins including polyethylene, polypropylene as well as polystyrene may be used. Additionally, polyesters may be used including polyethylene terepthalate and polyamides including nylons. While the web is not necessarily elastic, it is not intended to exclude elastic compositions. Compatible blends of any of the foregoing may also be used. In addition, additives such as processing aids, wetting agents, nucleating agents, compatibilizers, wax, fillers, and the like may be incorporated in amounts consistent with the fiber forming process used to achieve desired results. Other fiber or filament forming materials will suggest themselves to those of ordinary skill in the art. It is only essential that the composition be capable of spinning into filaments or fibers of some form that can be deposited on a forming surface. Since many of these polymers are hydrophobic, if a wettable surface is desired, known compatible surfactants may be added to the polymer as is well-known to those skilled in the art. Such surfactants include, by way of example and not limitation, anionic and nonionic surfactants such as sodium diakylsulfosuccinate (Aerosol OT available from American Cyanamid or Triton X-100 available from Rohm & Haas). The amount of surfactant additive will depend on the desired end use as will also be apparent to those skilled in this art. Other additives such as pigments, fillers, stabilizers, compatibilizers and the like may also be incorporated. Further discussion of the use of such additives may be had by reference to, for example, U.S. Pat. Nos. 4,374,888 issued on Bornslaeger on Feb. 22, 1983, and U.S. Pat. No. 4,070,218 issued to Weber on Jan. 24, 1978.

Additionally, a multitude of die configurations and die cross-sections may be utilized to create melt-blown non-woven webs in accordance with the present invention. For example orifice numbers of 20 to 50 holes per inch (hpi) are preferred. Moreover, virtually any appropriate orifice diameter may be utilized. Additionally, star-shaped, elliptical, circular, square, triangular, or virtually, any other geometrical shape for the cross-section of an orifice may be utilized for melt-blown non-woven webs.

Coform Applications

Figure 16:
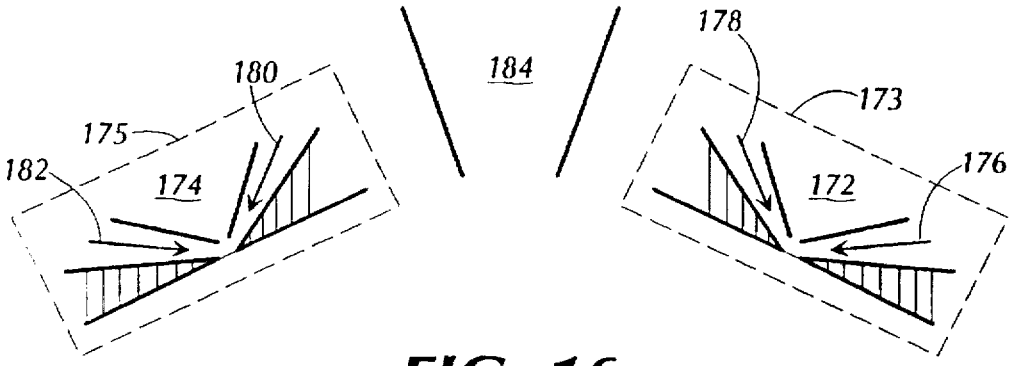
FIG. 16 is a schematic representation of a coform apparatus configured in accordance with the present invention.

Applicant hereby incorporate by reference U.S. Pat. No. 4,818,464, issued to Lau on Apr. 4, 1989 which discloses coform methods of polymer processing by combining separate polymer melt streams into a single polymer melt stream for extrusion through orifices in forming non-woven webs. Additionally, applicant hereby incorporates by reference U.S. Pat. No. 4,818,464, issued to Lau on Apr. 4, 1989 which discloses the introduction of superabsorbent material as well as pulp, cellulose, or staple fibers through a centralized chute in an extrusion die for combination with resin fibers in a non-woven web. Referring now to FIG. 16, a description of one form of the coform process is provided. In essence, a coform die is basically a combination of two melt-blown die heads 173, 175. Air flows 176 and 178 are provided around die 172 and air flows 180 and 182 are provided around die 174. A chute 184 is provided through which pulp, staple fibers, or other material may be added to vary the characteristics of the resulting web. Since any of the above described techniques to vary the airflow around a melt-blown die may be used in the coform technique, specific descriptions of all of the valving techniques will not be repeated. However, it will be apparent to one skilled in the art, that to vary the four air flows present in the coform die, the equipment used to control the perturbation of the air flows will have to be doubled.

In the coform technique, there are a variety of possible perturbation combinations. The most basic is to perturb each side of a given die 172 or 174 just as described above with respect to the melt-blown techniques (basically, air flows 176 and 178 alternating with each other and the same for airflows 180 and 182). However, it is also possible to perturb the air flows around die 172 relative to those around die 174. Thus, air flows 176 and 182 could be perturbed in phase with each other, but out of phase with air flows 178 and 180 to achieve a desired characteristic in the fibers or web. To achieve a different effect it may be desirable for air flows 176 and 180 to be perturbed in phase with each other, but out of phase with air flows 178 and 182. It should be readily apparent that with four air flows, many perturbation combinations are possible, all of which are within the scope of the present invention. For example, a centralized chute may be located between the two centralized air flows for introducing pulp or cellulose fibers and particulates. Such a centralized location facilitates integration of the pulp into the non-woven web and results in consistent pulp distribution in the web.

Example 5

As described above with reference to FIG. 16, coform materials are essentially made in the same manner as melt-blown materials with the addition of a second die. Thus, there are two airflows around each die, for a total of four air flows, which may be perturbed as described above. Additionally, there is typically a gap between the two dies through which pulp or other material may be added to the fibers produced and incorporated into the web being formed. The following example utilizes such a coforming arrangement, but otherwise, with respect to the airflow perturbation, conforms to the previous description of the melt-blown process.

Process Conditions

Die Tip Geometry:

Recessed

Gap=0.070"

Die Width=20"

Primary Air Flow: 350 scfm per bank (20" bank)

Primary Air Temperature: 510° F.

Auxiliary Air Flow: 40 scfm per MB bank

Polymer: PF-015 (polypropylene)

Pulp/Polymer Ratio: 65/35

Basis Weight: 75 gsm (2.2 osy)

Test Results

TABLE 5-1

| Perturbation Frequency | 0 Hz | 67 Hz | 208 Hz | 320 Hz |
|---|---|---|---|---|
| MD Peak Load | 1.578 | 1.501 | 1.67 | 2.355 |
| MD Elongation (%) | 23.86 | 22.48 | 24.21 | 20.23 |
| CD Peak Load | 0.729 | 0.723 | 0.759 | 0.727 |
| CD Elongation (%) | 49.75 | 52.46 | 58.08 | 71.23 |
| Cup Crush (gm/mm) | 2518 | 2485 | 2434 | 2281 |

From table 5-1, it can be seen that the results generally agree with those shown in the melt-blown examples. Generally, with increasing perturbation frequency, aligned along the MD, MD strength increased while CD strength remains about the same. Similarly, the softness, measured as cup crush, generally increases as the perturbation frequency increases (a lower cup crush value indicates increased softness). Thus, this example shows that the techniques previously described can be applied to coform-forming technology to achieve the process and material control by simple adjustment of the perturbation frequency in the same manner as they were applied to the melt-blown process.

Spunbond Applications

Figure 3A:
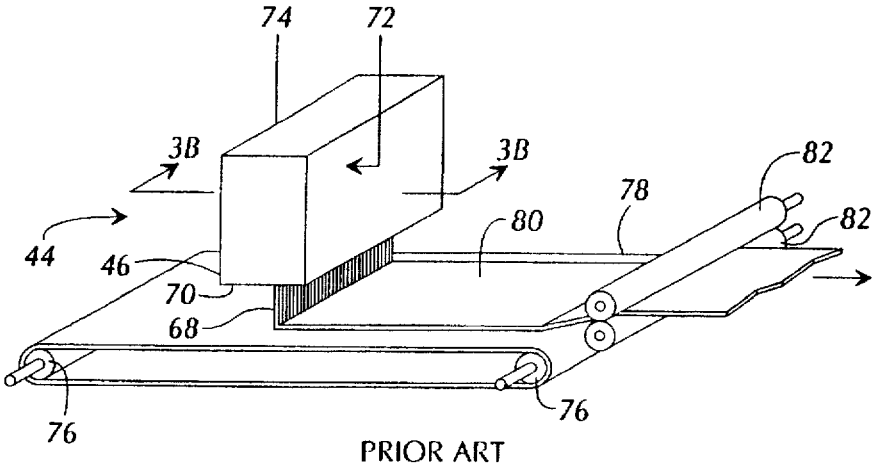
PRIOR ART FIG. 3A
FIGS. 3*a* and 3*b* illustrate schematic representations of a prior art apparatus for producing spunbond fibers.
Figure 3B:
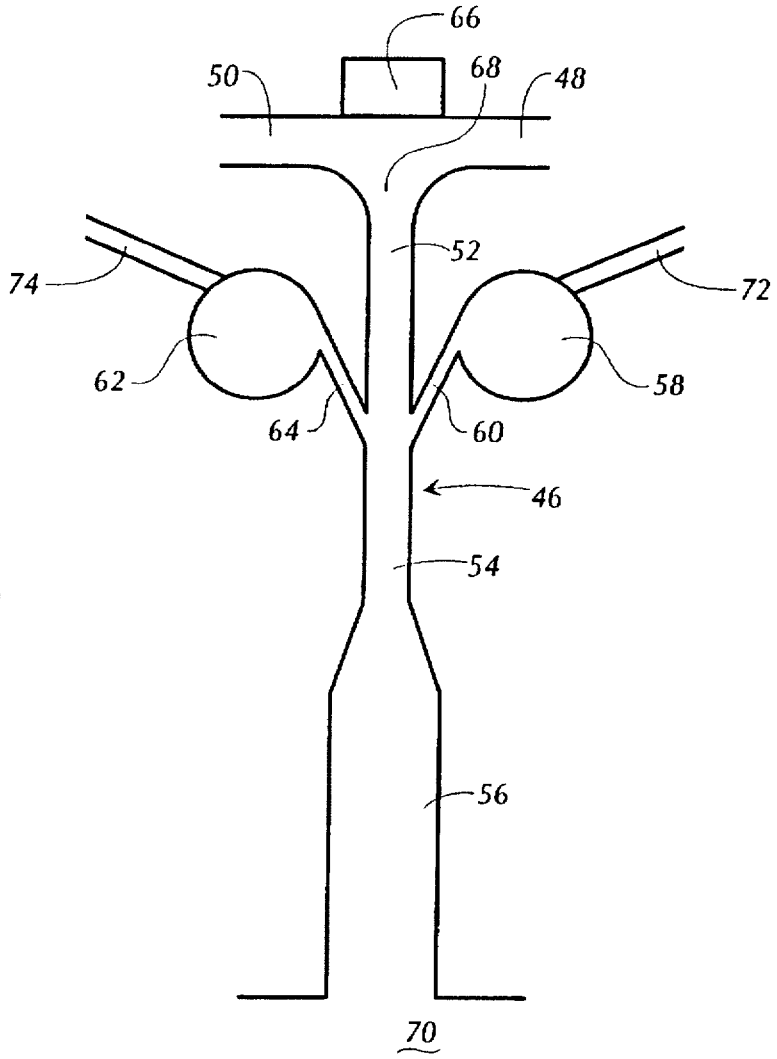
PRIOR ART FIG. 3B
Figure 17A:
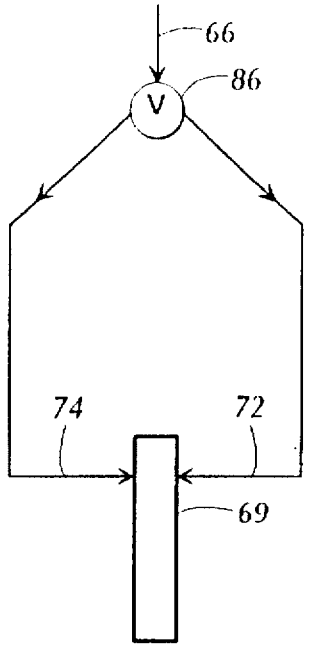
FIGS. 17*a*, 17*b*, 17*c* and 17*d* and 19 illustrate various apparatus configurations for manufacturing a non-woven web of spunbond fibers in accordance with the present invention.
Figure 17B:
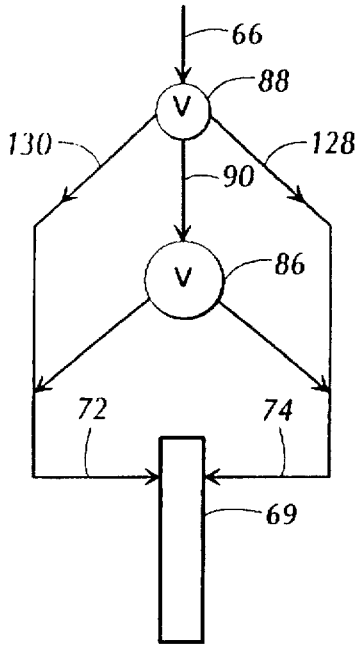
Figure 17C:
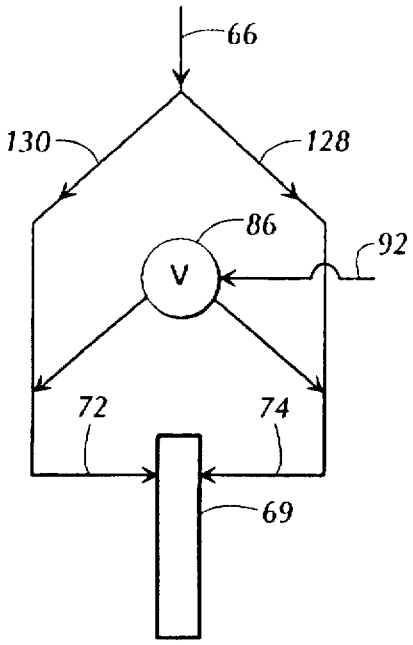
Figure 17D:
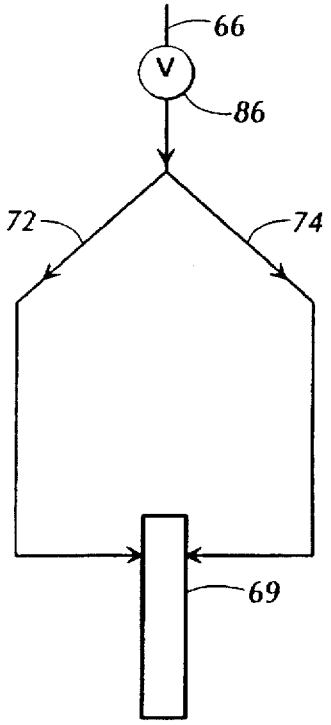

FIGS. 17*a* through 17*d* represent various embodiments which utilize alternatingly augmented air pressure in plenum chambers 58 and 62 of a standard fiber draw unit, as illustrated in FIG. 3*b*. In a manner similar to that of the valving arrangements for the melt-blown unit, the fiber draw unit may receive alternatingly augmented air pressure into plenum chambers 62 and 58 via lines 74 and 72, respectively, through the bifurcation of main air lines 66 via perturbation valve 86. Alternatively, as is illustrated in FIG. 17*b*, main air line 66 may be bifurcated by valve 86 into supply lines 130 and 128 with a third bleeder portion supplying perturbation valve 86. While lines 128 and 130 receive air from bleeder valve 88 at a relatively constant pressure, perturbation valve 86 receives bleed air from bleeder valve 88 and perturbs that air to create an oscillatory pressure which is then superimposed onto supply lines 128 and 130 to create alternatingly augmented pressure in lines 74 and 72 for supply to plenum chambers 62 and 58, respectively. In yet another embodiment illustrated in FIG. 17*c*, main supply line 66 bifurcates into lines 128 and 130. This embodiment utilizes an auxiliary air supply 92 which is perturbed by valve 86 superimposed onto the constant air pressure of lines 128 and 130 to create an alternatingly augmented air flow supply in lines 72 and 74 so as to supply air plenum chambers 62 and 58 of the fiber draw unit, respectively. Finally, FIG. 17*d* represents still another embodiment of the present invention which utilizes a perturbation valve 86 which provides an alternatingly perturbing air flow prior to the bifurcation of the main air supply line.

Figure 18A:
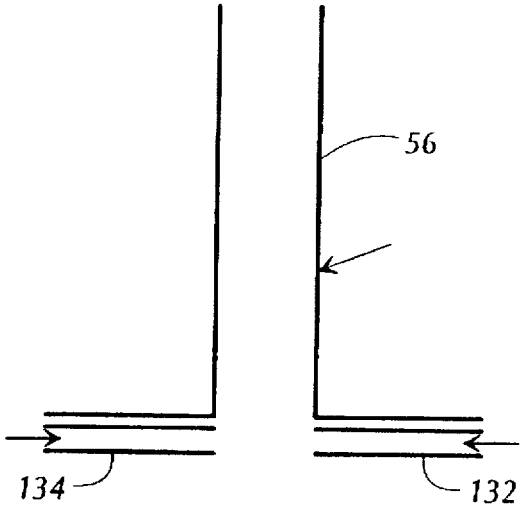
FIGS. 18*a*18*b*, 18*c*, 18*d*, 18*e* and 18*f*, 20*a* and 20*b*, and 21*a*, 21*b*, 21*c* and 21*d* illustrate various configurations of secondary jets for use with the present invention.

FIGS. 18*a* through 18f illustrate various locations for secondary perturbation jets which may be used with a standard prior art fiber draw unit such as the one illustrated in FIG. 3*b* to create the proper flow conditions for increasing desirable properties of fibers made in accordance with the present invention. For example, FIG. 18*a* illustrates the tail pipe 56 of a fiber draw unit which utilizes secondary perturbation jets 132 and 134. As described above, these secondary perturbation jets impose alternating augmented flow in a direction which is perpendicular to the main air flow through the tail pipe 56 of the present invention. This orthogonal relationship between primary and secondary air flow increases both the degree and order of turbulence of the air flow in the vicinity of the tail pipe 56.

Figure 18B:
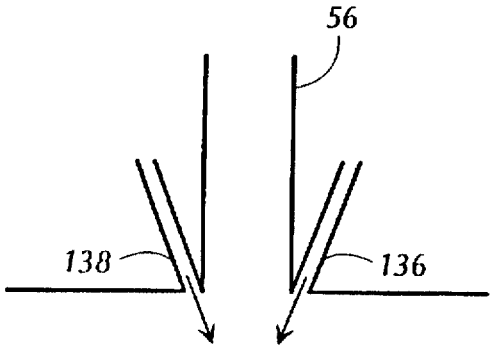
Figure 18C:
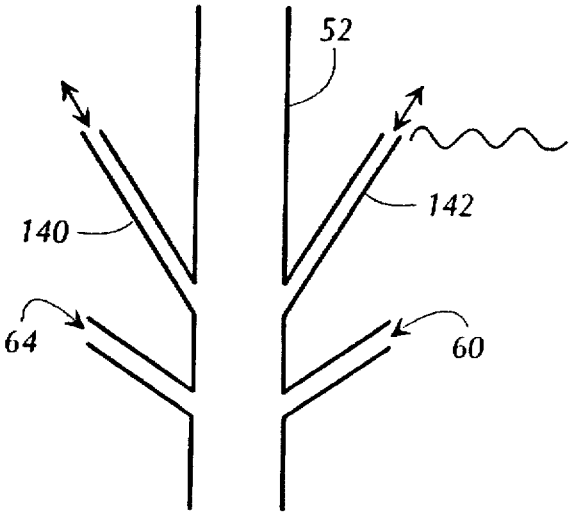
Figure 18D:
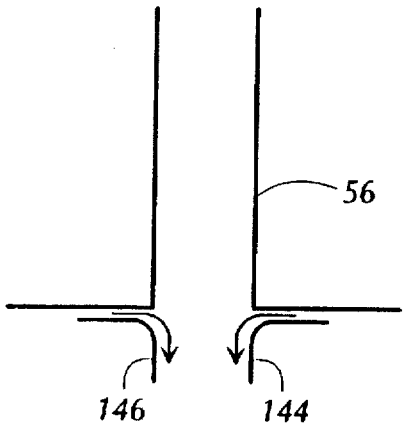
Figure 18E:
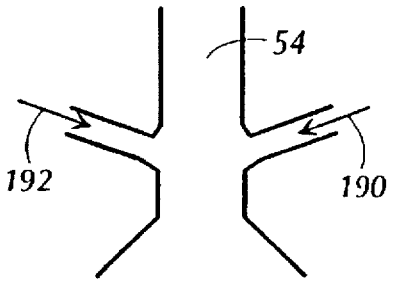
Figure 18F:
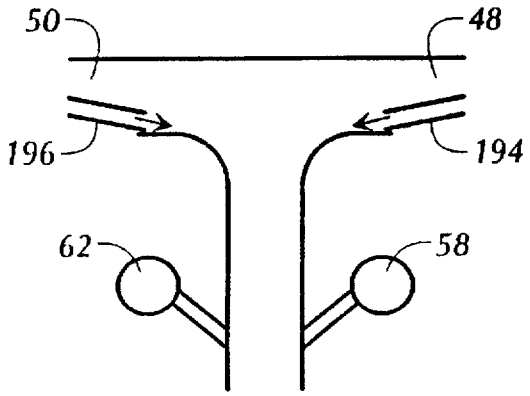

As illustrated in FIG. 18*b*, tail pipe 56 may also include alternatingly, or otherwise activated, co-flowing jets 136 and 138 to create turbulent flow in accordance with the present invention near the tail pipe of the fiber draw unit. FIG. 18*c* illustrates secondary perturbing jets 142 and 140 disposed near a top portion of the fiber draw unit upstream of plenum chamber inlets 60 and 64. FIG. 18*d* represents yet another embodiment of the present invention that utilizes alternatingly augmented flow through Coanda nozzles 144 and 146 at an exit of tail pipe 56 to create turbulent air flow in the vicinity of tail pipe 56. Additionally, FIG. 18*e* illustrates Coanda-like nozzles 190 and 192 disposed at mid portion 54 of the fiber draw unit. Finally, FIG. 18*f* illustrates jets at inlet portions 48 and 50 of the fiber draw unit. Each of those jets illustrated in FIGS. 18*a* through 18*f* may alternatingly perturb air flow through the fiber draw unit in addition to any perturbation which may be implemented upstream of the jets. Additionally, each of the jets illustrated in FIGS. 18*a*–18*f* may also be implemented without additional perturbation means upstream therefrom.

Figure 19:
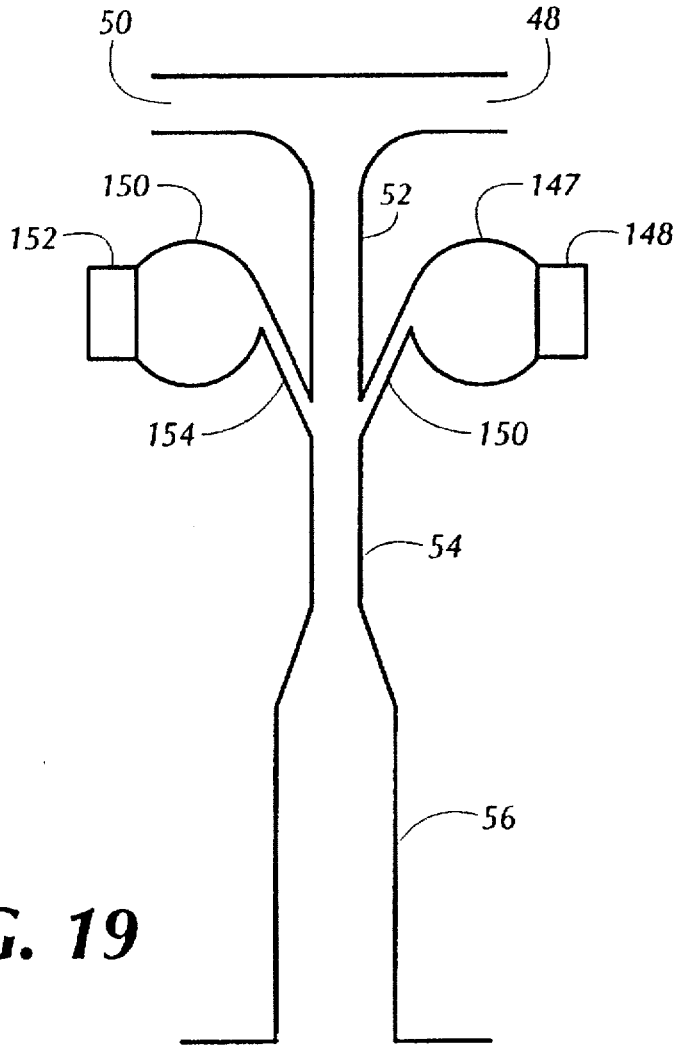

FIG. 19 represents yet another embodiment of the present invention. The alternatingly augmented pressure in plenum chambers 147 and 150 may be provided by transducers 148 and 152 via inlets 150 and 154, respectively. Transducers 148 and 152 are preferably actuated by means of an electrical signal. For example, the transducers may actually be large speakers which receive an electrical signal to activate 0° to 180° out of phase in order to provide the alternating augmented pressures in plenum chambers 147 and 150. However, any type of appropriate transducer may create an augmented air flow by using any means of actuation. This may include but is not limited to electromagnetic means, hydraulic means, pneumatic means or mechanical means.

Figure 20A:
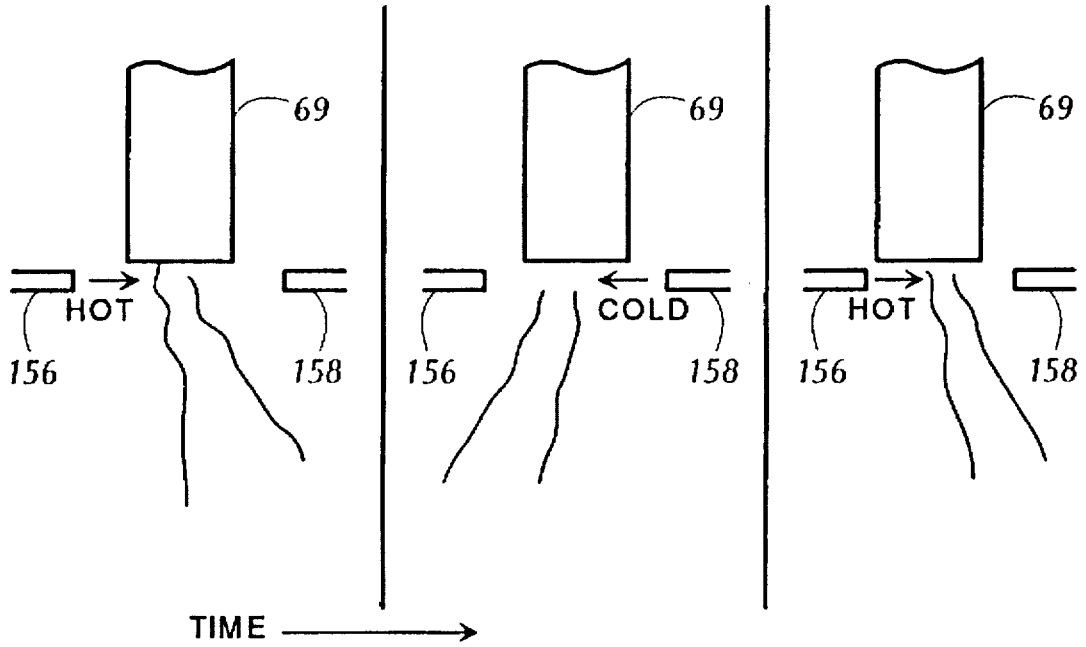
Figure 20B:
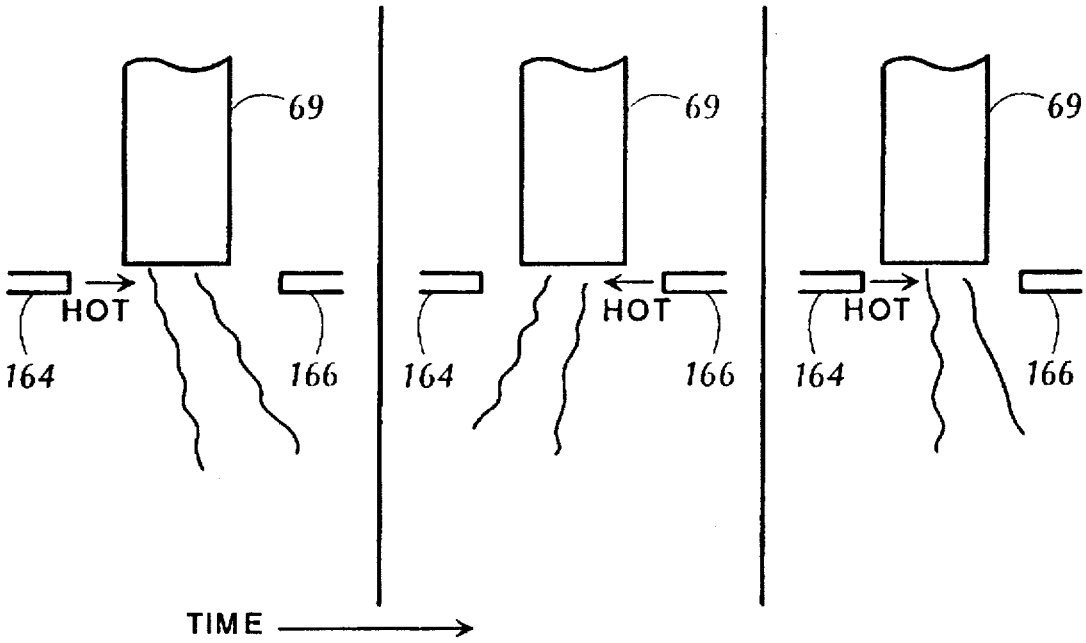
Figure 21A:
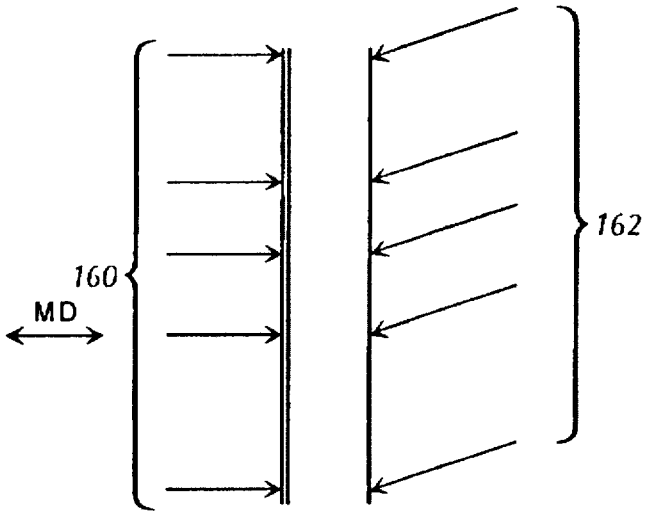
Figure 21B:
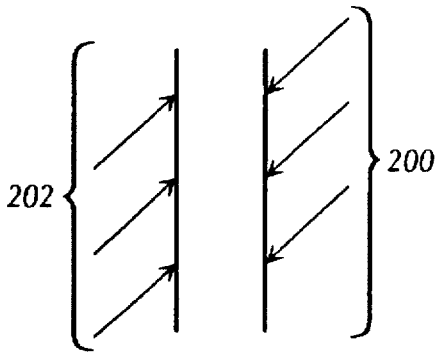
Figure 21D:
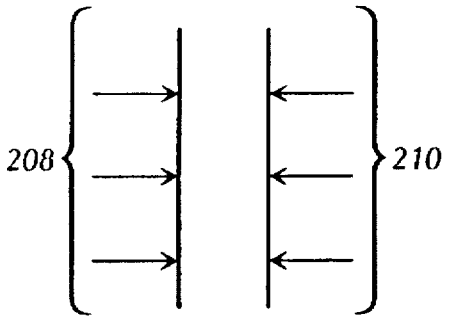
Figure 21C:
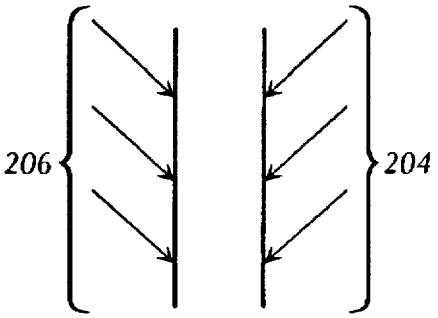

FIGS. 20*a* and 20*b* illustrate yet another embodiment of the present invention wherein hot and cold jets are alternatingly used to increase fiber crimp. Referring to FIG. 20*a*, fiber draw unit 69 includes secondary perturbation jets 156 and 158. Oscillatory jet 156 supplies hot air whereas oscillatory air jet 158 supplies cold air. Alternatively, FIG. 20*b* illustrates perturbation air jets 164, 166, which alternatingly supply hot air to the primary air flow and fiber bundle exiting from the tail pipe of the fiber draw unit. Both FIGS. 20*a* and 20*b* illustrate the fiber bundle deflection upon application of secondary perturbation. This secondary perturbation creates fiber bundle deflection and heating or cooling effects which lead to added crimp of the fibers being distributed within a web on an endless belt. The temperature varied perturbation provides for additional parameters which may be varied and controlled during production. The jets may be symmetrically or asymmetrically oriented to achieve desired fiber characteristics, namely fiber crimp. As with perturbation frequency and amplitude, the temperature of the air may be controlled without interruption of the production process, although this control is more complex. Thus, materials having different properties can be made without requiring the line to be substantially delayed and without the need for additional equipment. This technique may be applied to processes utilizing the homopolymer fibers as well as to multi-component fibers and materials.

FIGS. 21(*a*) through 21(*d*) represent yet another embodiment of the present invention, wherein a standard fiber draw unit includes secondary perturbation jets at an exit of the tail pipe thereof wherein at least one bank of perturbation jets is rotated with respect to the machine direction to create a crimp or fiber movement in a cross direction with respect to travel of the belt within the fiber draw unit apparatus to increase tensile strength in the cross direction of the non-woven web. For example, as shown in FIG. 21(*a*), jet bank 162 is disposed at an angle with respect to the machine direction while jet bank 160 is essentially parallel to the machine direction. FIG. 21(*b*) illustrates jet banks 202 and 200 which are both disposed at an angle with respect to the machine direction but oppose one another. Furthermore, FIG. 21(*c*) illustrates yet another configuration for jet orientation. There, jet banks 202 and 204 are each rotated with respect to the machine direction and face in the same direction. Finally, FIG. 21(*d*) illustrates opposing jet banks 208 and 210.

Figure 15:
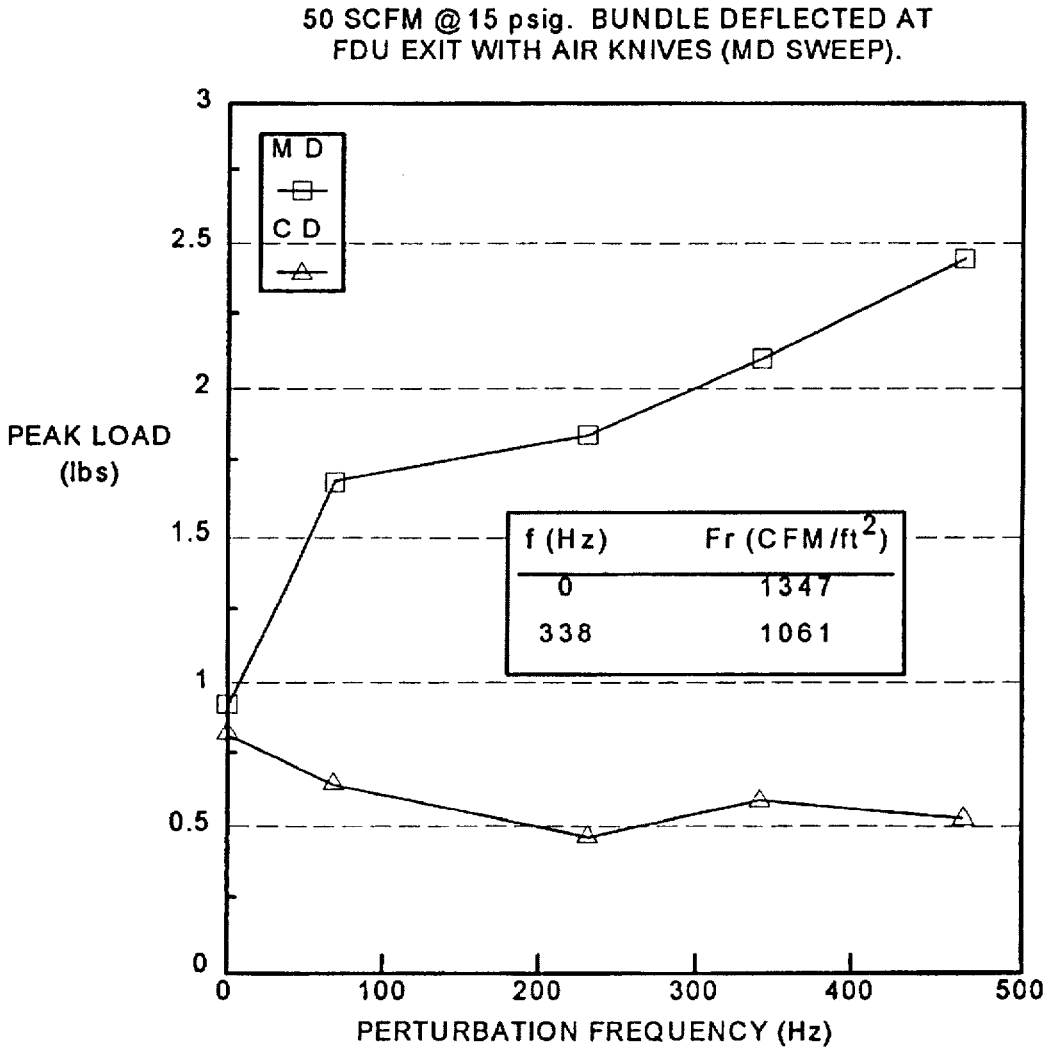
FIG. 15 illustrates peak load as a function of perturbation frequency of a non-woven web of spunbond fibers.

Finally, FIG. 15 illustrates the peak load of a non-woven web sample as a function of perturbation frequency of secondary perturbation jets for the embodiment utilized in Example 6. As is illustrated in the chart, machine direction strength of the non-woven web increases with increasing perturbation frequency. In the process run used to generate the data for FIG. 15, the direction of perturbation was parallel to the machine direction, as illustrated in FIG. 21(*d*). Furthermore, by varying the direction of the perturbation jets or airstreams relative to the machine direction, it is possible to increase cross-direction strength.

The following examples show the application of the techniques of the present invention to the production of fibers and non-woven webs in the spunbond process. The processes and apparati are described using terms and units well known in the prior art. The initial example describes fibers and a web formed using prior art techniques to provide a basis for comparison for fibers and webs formed using the techniques of the present invention.

Example 6

The following examples show the application of perturbing airflows to the spunbond process. In this particular example, the perturbing airflows were applied to the air stream carrying the fibers at the exit of the fiber draw unit (FDU), which corresponds to the embodiment shown in FIG. 21(*d*). However, as was previously described, the process is equally applicable to perturbing the airflow in the FDU itself, or by application of auxiliary air, or bleeding airflow, at the manifolds prior to the FDU.

Process Conditions

FDU Draw Pressure:

4 psi

Draw unit width=14"

Polymer Throughput:

0.5 GHM

Polymer: 3445 Polypropylene*

*Exxon brand 3445 polymer, peroxide coated

Melt Temperature: 430° F.

Auxiliary Flow: 40 scfm

Basis Weight: 0.5 osy (17 gsm)

Test Results

TABLE 6-1

| Perturbation Frequency Hz | 0 | 67 | 227 | 338 | 463 |
|---|---|---|---|---|---|
| MD Peak Load (lb) | 0.921 | 1.687 | 1.844 | 2.108 | 2.452 |
| CD Peak Load (lb) | 0.824 | 0.645 | 0.462 | 0.586 | 0.521 |
| MD Elongation (%) | 23.85 | 52.79 | 18.03 | 11.08 | 23.05 |
| CD Elongation (%) | 60.84 | 46.5 | 42.31 | 38.76 | 57.10 |
| Total Tensile $(MD^2 + CD^2)^{1/2}$ | 1.24 | 1.81 | 1.90 | 2.19 | 2.51 |

As can be seen from the Table, the use of perturbing airflows in the spunbond process provides substantially increased MD strength (in this example, the perturbing airflows were aligned with the machine direction). As was the case with the melt-blown process with perturbed airflows, the CD strength remained relatively constant after a slight decrease. As the total tensile strength calculation indicates, however, the overall strength of the web is increased by the application of the perturbing airflows. Once again, as was demonstrated with the use of perturbation of airflow in the melt-blown process, the use of airflow perturbation provides for a range of selectable characteristics in the final web material, merely by adjusting the perturbation frequency. This ease of process control is not currently available in the spunbond art. Typically, to prepare spunbond web materials with varying properties, the processing equipment must be completely shut down and the process conditions changed, such as by changing the die or other substantial change to the equipment. Though the present invention does not preclude those processes, with the present process, such changes to the web material may be accomplished on the fly by merely changing the perturbation frequency while the other process conditions remain constant. This feature of the present invention allows for much greater flexibility and efficiency in the operation of spunbond equipment.

Example 7

In this example, the spunbond process was adapted, using the techniques disclosed herein to provide for perturbing airflows disposed at the exit of the FDU. For the purposes of this example, the perturbing airflows were not disposed immediately opposite each other, as was the case in Example 6, but rather one bank of auxiliary air nozzles was directed parallel to the machine direction, while the other was directed at an angle with respect to the cross direction to provide a slight cross direction trajectory (as shown schematically in FIG. 21(*a*)).

Process Conditions

Fiber Draw Pressure: 9 psi

Polymer Throughput: 0.75 GHM

Basis Weight: 1.0 oz/yd$^2$

Polymer: 3445 Polypropylene*

*Exxon brand 3445 polymer, peroxide coated

Melt Temperature: 450° F.

Auxiliary Air Flow: 75 scfm

Test Results

TABLE 7-1

| Perturbation Frequency Hz | 0 | 115 | 195 | 338 | 500 |
|---|---|---|---|---|---|
| MD Peak Load (lb) | 12.00 | 19.96 | 21.00 | 21.13 | 20.00 |
| MD Elongation (%) | 34.75 | 37.36 | 38.36 | 39.77 | 37.48 |
| CD Peak Load (lb) | 8.965 | 11.30 | 10.53 | 10.34 | 12.69 |
| CD Elongation (%) | 40.10 | 49.78 | 52.84 | 43.18 | 47.94 |

Once again, it can be seen that by simply varying the perturbation frequency of the airflow, a variety of changes can be effectuated in the final non-woven web. Thus, to the extent that a material having different characteristics is desired, varying the perturbation frequency of the perturbing airflow can result in substantial changes in the final non-woven material. This change represents a substantial departure from prior art spunbond techniques in which other process conditions, which are much more difficult to achieve, must be varied to vary the characteristics of the final material.

Figure 22:
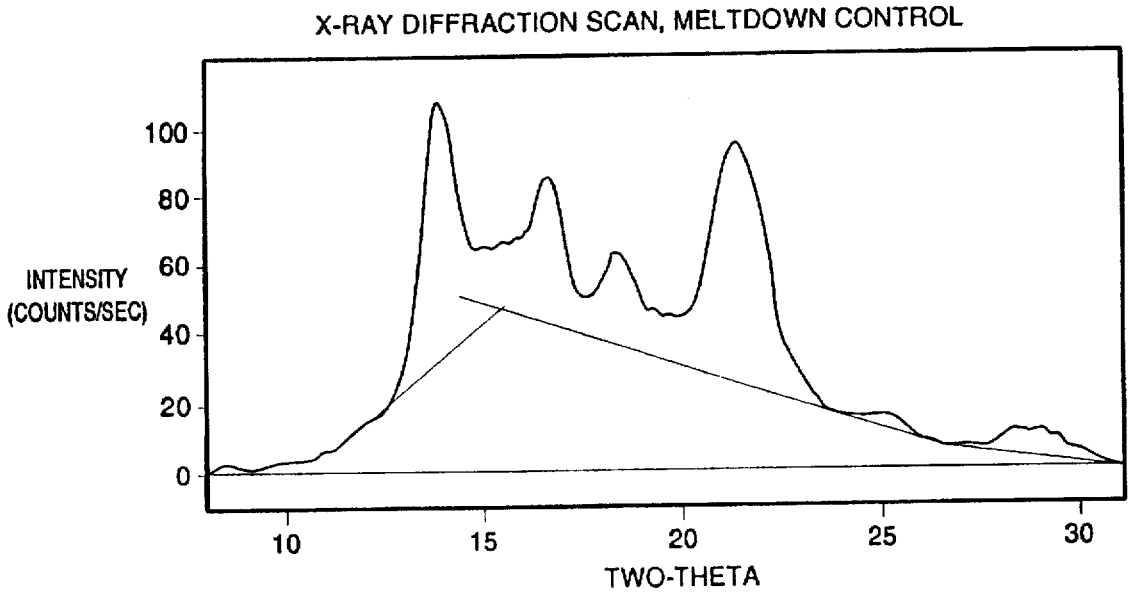
FIGS. 22 and 23 are X-Ray Diffraction Scans of a prior art meltblown fiber and a fiber made in accordance with the present invention.
Figure 23:
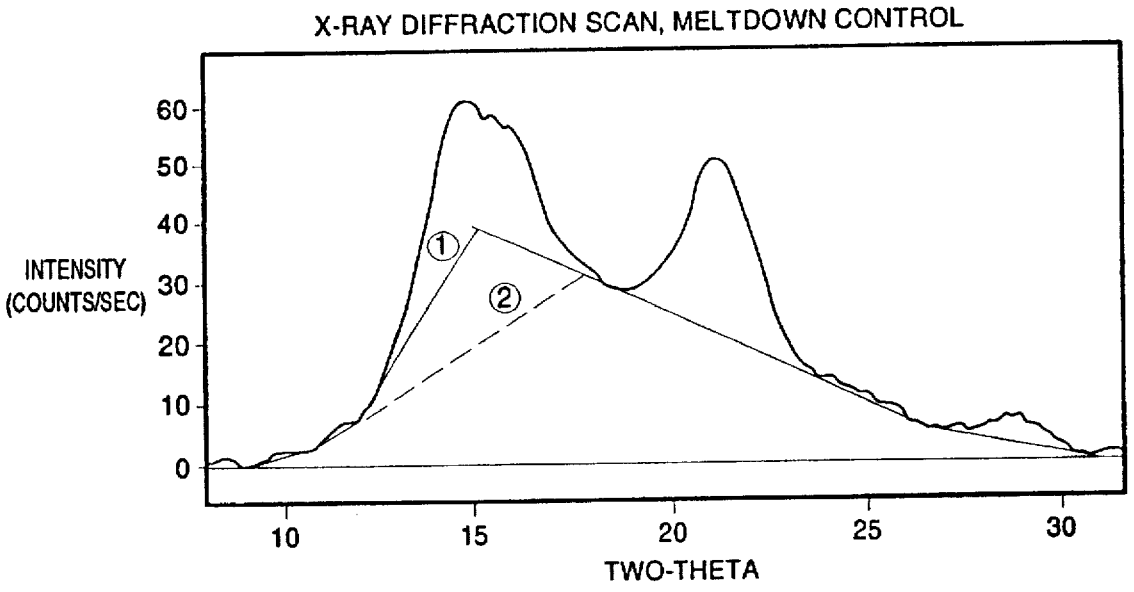

As is seen from the above Examples 1–7 of meltblown, coform and spunbond non-wovens made in accordance with the present invention, the techniques of the present invention allow for the formation of a non-woven webs of various characteristics with relatively simple adjustments to process controls. While some of the differences can be attributed to the lay-down of the fibers on the forming surface, preliminary investigation indicates that the present inventive techniques also result in fundamental changes to the fibers formed thereby. Referring now to FIGS. 22 and 23, there are shown X-Ray diffraction scans of a meltblown fiber made according to prior art techniques (FIG. 22) and a meltblown fiber made in accordance with the present invention (FIG. 23) both otherwise under identical processing conditions and polymer type. As can be seen from comparison of FIGS. 22 and 23, the X-Ray scan of the meltblown fiber made with the inventive techniques has two peaks, while that of the prior art meltblown fiber has several peaks. It is believed that the differences observed in FIG. 23 result from the presence of smaller crystallites in the fiber, which possibly result from better quenching of the fiber during formation. In summary, these X-Ray diffraction scans indicate that the fibers made in accordance with the present technique are more amorphous than prior art fibers and may have a broader bonding window than fibers made in accordance with prior art techniques.

Figure 24:
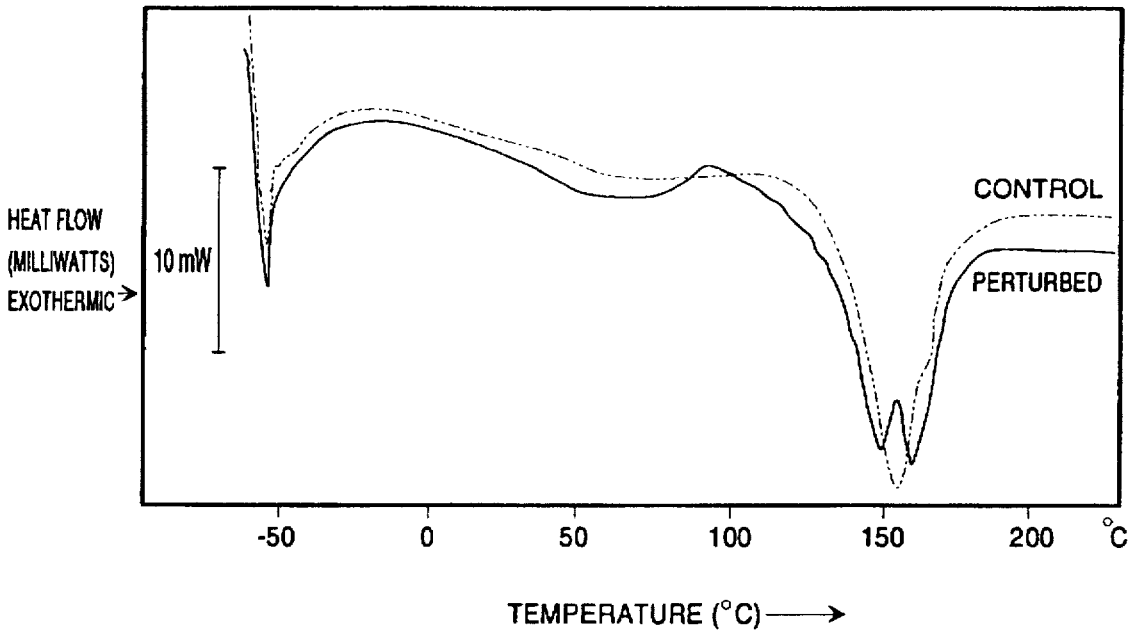
FIG. 24 is a DSC (Differential Scanning Calorimetry) comparing the calorimetric characteristics of a prior art meltblown fiber and a fiber made in accordance with the present invention.

Additional evidence of the believed characteristic differences between fiber made in accordance with the present invention and those made in accordance with the prior art are shown in FIG. 24. FIG. 24 is a graph showing the results of a Differential Scanning Calorimetry (DSC) test conducted on a prior art meltblown fiber (indicated by the dashed line on the graph) and with a fiber made in accordance with the present techniques (the solid line). The test basically observes the absorbance or emission of heat from the sample while the sample is heated. As can be seen from FIG. 24, the DSC scan of the prior art fiber is significantly different from that of the present fiber. A comparison of DSC scans shows two main features in the present fiber that do not appear in the prior art fiber: (1) heat is given off from 80°–110° C. (apparent exotherm) and (2) a double melting peak. It is believed that these DSC results confirm that the present formation techniques produce fibers having significant differences from fibers produced with prior art techniques. Once again, it is believed that these differences relate to crystalline structure and quenching of the fiber during formation.

While preferred embodiments of the present invention have been described in the foregoing detailed description, the invention is capable of numerous modifications, substitutions, additions and deletions from the embodiments described above without departing from the scope of the following claims. For example, the teachings of the present application could be applied to the atomizing of liquids into a mist (or entraining a liquid in a fluid flow such as air). An apparatus for entraining such liquids is very similar, in cross section, to the melt-blown apparatus shown in FIGS. 6A–6D. In this embodiment, the apparatus simply would not have the typical melt-blown width of several inches to several feet. Additionally, the components of an atomizer would typically be several orders of magnitude smaller. In any event, the perturbation techniques in an atomizing embodiment provide for narrow droplet size distribution and more even distribution of the small liquid droplets in the entraining air flow. This embodiment could be employed in many applications such as creating fuel/air mixtures for engines, improved paint sprayers, improved pesticide applicators, or in any application in which a liquid is entrained in an airflow and an even distribution of the liquid and narrow particle size distribution in the airflow is desired.

What is claimed is:

1. Apparatus for forming artificial fibers from a liquefied resin comprising:

means for generating a substantially continuous steady state fluid stream flow along a primary a first extrusion die for extruding the liquefied resin, said die located adjacent to the fluid stream for injecting said liquefied resin in the fluid stream along said primary axis to form fibers; and perturbation means for selectively perturbing the flow of fluid in the fluid stream by superimposing alternating pressure perturbations on said steady state flow by varying the fluid pressure on either side of the primary axis of said steady state fluid flow.

2. The apparatus of claim 1 further comprising:

a substrate disposed below said first die;

substrate translation means for moving said substrate relative to said first die, the direction of movement of said substrate defining a machine direction;

said first die oriented perpendicular to said machine direction in a cross-direction; and wherein the fibers are deposited on said substrate to form a non-woven web.

3. The apparatus of claim 1 wherein said means for generating a substantially continuous fluid stream further comprises:

a first supply of fluid having a flow rate;

first and second longitudinal fluid plenum chambers located on opposite sides of said axis, each said plenum chamber including at least a first inlet and an outlet;

first and second plenum conduits for directing at least a portion of said supply of fluid to the inlet of each of said first and second longitudinal fluid plenum chambers; and first and second exit conduits extending from the outlet of each of said first and second plenum chambers to a location adjacent said die, on opposite sides of said primary axis, and directing fluid from each of said first and second plenum chambers to a location adjacent said first die to form said substantially continuous fluid stream.

4. The apparatus of claim 3 further comprising:

a primary fluid conduit connected between said first supply of fluid and said perturbation means;

said first plenum conduit connected between said perturbation means and said inlet on said first plenum;

said second plenum conduit connected between said perturbation means and said inlet on said second plenum; and wherein said perturbation means divides said first supply of fluid between said first and second plenum conduits and selectively varies the pressure of fluid flowing in each of said first and second plenum conduits.

5. The apparatus of claim 3 further comprising:

a second supply of fluid having a flow rate;

an auxiliary conduit connected between said second supply of fluid and said perturbation means;

a second inlet located in each of said first and second plenum chambers;

at least a first secondary conduit fluidly coupled between said perturbation means and said second inlet in said first plenum chamber, directing fluid flow from said perturbation means to said second inlet in said first plenum chamber;

at least a second secondary conduit fluidly coupled between said perturbation means and said second inlet in said second plenum chamber, directing fluid flow from said perturbation means to said second inlet in said second plenum chamber; and said perturbation means further comprising a perturbation valve means for selectively varying the fluid flow rate provided from said auxiliary conduit to said first and second secondary conduits, said selective variation of the fluid flow rate providing said pressure variation on either side of said primary axis.

6. The apparatus of claim 5 further comprising:

a three way valve comprising;

an inlet connected to and receiving said first supply of fluid;

first and second outlets directing fluid flow into said first and second plenum conduits; and a third outlet for adjustably bleeding fluid flow from said first supply of fluid to said auxiliary conduit to provide said second supply of fluid.

7. The apparatus of claim 5 wherein said perturbation means includes a perturbation valve comprising:

an inlet for receiving fluid flow from said auxiliary conduit; and first and second outlets for delivering selectively varied fluid flow to said first and second secondary conduits.

8. The apparatus of claim 3 wherein said perturbation means further comprises a perturbation valve further comprising:

an inlet for receiving fluid flow from said second fluid source; and first and second outlets for delivering selectively varied fluid flow to said first and second plenum conduits.

9. The apparatus of claim 3 wherein said perturbation means further comprises:

first and second pressure transducers adjacent to said first and second plenum chambers; and means for selective activation of said first and second pressure transducers for selectively varying the pressure in said first and second plenum chambers.

10. The apparatus of claim 3 wherein said perturbation means varies a steady state pressure in each said first and second plenum chambers at a perturbation frequency of approximately less than 1000 Hertz.

11. The apparatus of claim 3 wherein said perturbation means varies an average plenum pressure in said first and second plenum chambers less than about 50% of the total average plenum pressure in the absence of activation of said perturbation means.

12. The apparatus of claim 2 further comprising:

means for directing fluid flow from at least one of exit conduits in a non-parallel direction with respect to the machine direction.

13. The apparatus of claim 5 further comprising:

first and second secondary pulsing jets disposed on opposite sides of said axis and near said die for alternatingly perturbing said substantially continuous flow of fluid.

14. The apparatus of claim 13 further comprising:

means for positioning said first and second secondary jets between said fiber draw unit inlet and outlet.

15. The apparatus of claim 13 further comprising:

means for directing fluid flow from at least one of said first and second secondary jets in a substantially horizontal orientation.

16. The apparatus of claim 13 further comprising:

means for directing fluid flow from at least one of said first and second secondary jets in a downward orientation.

17. The apparatus of claim 13 further comprising:

means for directing fluid flow from at least one said secondary jets in a non-parallel direction with respect to the machine direction.

18. The apparatus of claim 13 further comprising:

means for providing hot fluid from said first secondary jet; and means for providing fluid at an approximately ambient temperature from said second secondary jet.

19. The apparatus of claim 1 further comprising:

means for extruding a second liquefied resin through a second die positioned adjacent said first die, said second die located adjacent to the fluid stream for injecting said liquefied resin in said fluid stream to form fibers.

20. The apparatus of claim 19 further comprising:

means for directing fluid flow between said first and second dies; and means for directing fluid flow near peripheral portions of said first and second dies.

21. The apparatus of claim 20 further comprising:

a chute disposed between said first and second dies for introducing pulp fibers into said continuous fluid stream.

22. The apparatus of claim 1 further comprising:

a fiber draw unit disposed below said first die and adapted to channel the primary fluid flow therethrough, said fiber draw unit including, an fiber inlet at a top portion thereof for receiving fluid flow and fibers, and an outlet for dispensing the fibers.

23. The apparatus of claim 22 further comprising:

a substrate disposed below said first die;

substrate translation means for moving said substrate relative to said first die, the direction of movement of said substrate defining a machine direction;

said first die oriented perpendicular to said machine direction in a cross-direction; and wherein the fibers are deposited on said substrate to form a non-woven web.

24. The apparatus of claim 22 wherein said means for generating a substantially continuous fluid stream further comprises:

a first supply of fluid having a flow rate;

first and second longitudinal fluid plenum chambers located on opposite sides of said axis, each said plenum chamber including at least a first inlet and an outlet;

first and second plenum conduits for directing at least a portion of said supply of fluid to the inlet of each of said first and second longitudinal fluid plenum chambers; and first and second exit conduits extending from the outlet of each of said first and second plenum chambers to said fiber draw unit, on opposite sides of said primary axis, for directing fluid from each of said first and second plenum chambers to said fiber draw unit to form said substantially continuous fluid stream into said fiber draw unit.

25. The apparatus of claim 24 further comprising:

a primary fluid conduit connected between said first supply of fluid and said perturbation means;

said first plenum conduit connected between said perturbation means and said inlet on said first plenum;

said second plenum conduit connected between said perturbation means and said inlet on said second plenum; and wherein said perturbation means divides said first supply of fluid between said first and second plenum conduits and selectively varies the pressure of fluid flowing in each of said first and second plenum conduits.

26. The apparatus of claim 24 further comprising:

a second supply of fluid having a flow rate;

an auxiliary conduit connected between said second supply of fluid and said perturbation means;

a second inlet located in each of said first and second plenum chambers;

at least a first secondary conduit fluidly coupled between said perturbation means and said second inlet in said first plenum chamber, directing fluid flow from said perturbation means to said second inlet in said first plenum chamber;

at least a second secondary conduit fluidly coupled between said perturbation means and said second inlet in said second plenum chamber, directing fluid flow from said perturbation means to said second inlet in said second plenum chamber; and said perturbation means further comprising a perturbation valve means for selectively varying the fluid flow rate provided from said auxiliary conduit to said first and second secondary conduits, said selective variation of the fluid flow rate providing said pressure variation on either side of said primary axis.

27. The apparatus of claim 26 further comprising:

a three way valve comprising:

an inlet connected to and receiving said first supply of fluid;

first and second outlets directing fluid flow into said first and second plenum conduits; and a third outlet for adjustably bleeding fluid flow from said first supply of fluid to said auxiliary conduit to provide said second supply of fluid.

28. The apparatus of claim 24 wherein said perturbation means includes a perturbation valve comprising:

an inlet for receiving fluid flow from said auxiliary conduit; and first and second outlets for delivering selectively varied fluid flow to said first and second secondary conduits.

29. The apparatus of claim 24 wherein said perturbation means further comprises a perturbation valve further comprising:

an inlet for receiving fluid flow from said second fluid source; and first and second outlets for delivering selectively varied fluid flow to said first and second plenum conduits.

30. The apparatus of claim 24 wherein said perturbation means further comprises:

first and second pressure transducers adjacent to said first and second plenum chambers; and means for selective activation of said first and second pressure transducers for selectively varying the pressure in said first and second plenum chambers.

31. The apparatus of claim 22 further comprising:

first and second secondary pulsing jets disposed on opposite sides of said axis and near said fiber draw unit for alternatingly perturbing said substantially continuous flow of fluid.

32. The apparatus of claim 31 further comprising:

means for positioning said first and second secondary jets between said fiber draw unit inlet and outlet.

33. The apparatus of claim 31 further comprising:

means for directing fluid flow from at least one of said first and second secondary jets in a substantially horizontal orientation.

34. The apparatus of claim 31 further comprising:

means for directing fluid flow from at least one of said first and second secondary jets in a downward orientation.

35. The apparatus of claim 31 further comprising:

means for directing fluid flow from at least one of said secondary jets in a non-parallel direction with respect to the machine direction.

36. The apparatus of claim 31 further comprising:

means for providing hot fluid from said first secondary jet; and means for providing fluid at an approximately ambient temperature from said second secondary jet.

37. The apparatus of claim 22 wherein said perturbation means varies a steady state pressure in each said first and second plenum chambers at a perturbation frequency of approximately less than 1000 Hertz.

38. The apparatus of claim 1 wherein said fluid is a gas.

39. The apparatus of claim 1 wherein said fluid is air.

40. An apparatus for entraining a liquid within a fluid flow comprising:

means for generating a substantially continuous steady state fluid stream flow along a primary axis;

a first nozzle for injecting the liquid into said fluid stream along said primary axis, said first nozzle located adjacent to the fluid stream; and perturbation means for selectively perturbing the flow of fluid in the fluid stream by superimposing alternating pressure perturbations on said steady state flow by varying the fluid pressure on either side of the primary axis of said steady state fluid flow.

* * * * *

UNITED STATES PATENT AND TRADEMARK OFFICE

CERTIFICATE OF CORRECTION

PATENT NO. : 5,711,970

DATED : January 27, 1998

INVENTOR(S) : Jark C. Lau
Bryan D. Haynes

It is certified that error appears in the above-identified patent and that said Letters Patent is hereby corrected as shown below:

FIGS. 8B and 8C, delete the words "PRIOR ART"

Column 23, Line 48, "primary" should read -- primary axis; --

Column 2, Line 44, "fiber" should read -- fibers --

Column 7, Line 1, "specification" should read -- specifications --

Column 17, Line 32, "Applicant hereby incorporate" should read -- Applicants hereby incorporate --

Column 17, Line 37, "applicant" should read -- applicants --

Column 17, Line 37, "incorporates" should read -- incorporate --

Signed and Sealed this

Fifth Day of January, 1999

*Attest:*

*Attesting Officer*

*Acting Commissioner of Patents and Trademarks*